US011378284B2

(12) United States Patent
Lockwood

(10) Patent No.: US 11,378,284 B2
(45) Date of Patent: Jul. 5, 2022

(54) FAN AND AIR CONDITIONING UNIT COMPRISING THE SAME

(71) Applicant: OVE ARUP VENTURES LIMITED, London (GB)

(72) Inventor: Geoffrey Mark Lockwood, Chelmsford (GB)

(73) Assignee: Artus Air Limited, London (GB)

( * ) Notice: Subject to any disclaimer, the term of this patent is extended or adjusted under 35 U.S.C. 154(b) by 17 days.

(21) Appl. No.: 16/956,572

(22) PCT Filed: Dec. 6, 2018

(86) PCT No.: PCT/GB2018/053534
§ 371 (c)(1),
(2) Date: Jun. 20, 2020

(87) PCT Pub. No.: WO2019/122814
PCT Pub. Date: Jun. 27, 2019

(65) Prior Publication Data

US 2021/0164666 A1 Jun. 3, 2021

(30) Foreign Application Priority Data

Dec. 22, 2017 (GB) ..... 1721773

(51) Int. Cl.

| | |
|---|---|
| ***F24F 1/0029*** | (2019.01) |
| ***F24F 1/0047*** | (2019.01) |
| ***F04D 19/00*** | (2006.01) |
| ***F24F 1/0011*** | (2019.01) |
| ***F04D 25/06*** | (2006.01) |
| ***F04D 29/60*** | (2006.01) |

(52) U.S. Cl.
CPC ..... *F24F 1/0029* (2013.01); *F04D 19/002* (2013.01); *F04D 25/06* (2013.01); *F04D 29/601* (2013.01); *F24F 1/0011* (2013.01); *F24F 1/0047* (2019.02)

(58) Field of Classification Search
CPC ..... F24F 1/0029; F24F 1/0047; F04D 19/002
USPC ..... 454/233
See application file for complete search history.

(56) References Cited

U.S. PATENT DOCUMENTS 2,252,064 A 8/1941 Cornell, Jr.
5,120,193 A * 6/1992 Kadle ..... F04D 29/663 415/119

(Continued)

FOREIGN PATENT DOCUMENTS

JP 2001065491 A 3/2001
WO 2016016659 A1 2/2016

*Primary Examiner* — Allen R. B. Schult
(74) *Attorney, Agent, or Firm* — Craft Chu PLLC; Andrew W. Chu

(57) ABSTRACT

A fan includes a motor, an impeller and a stator. The fan defines an air flow passage between an air inlet and an air outlet. The fan has a mode of operation and an arrangement such that, in use, the trajectory of the air flow through the air inlet is up to 360° in a direction which is generally perpendicular to the axis of rotation of the impeller. The trajectory of the air flow through the air outlet is up to 360° in a direction which is generally perpendicular to the axis of rotation of the impeller, and the air flow through the air flow passage turns generally 180°. The fan has a mode of constant operation, and, in this mode, the operating point of the fan falls with the stall region of the fan characteristic.

25 Claims, 25 Drawing Sheets

(56) References Cited

U.S. PATENT DOCUMENTS

| | | | |
|---|---|---|---|
| 2012/0219398 | A1 | 8/2012 | Sheard et al. |
| 2013/0149115 | A1 | 6/2013 | Chang et al. |

* cited by examiner

Section

Plan

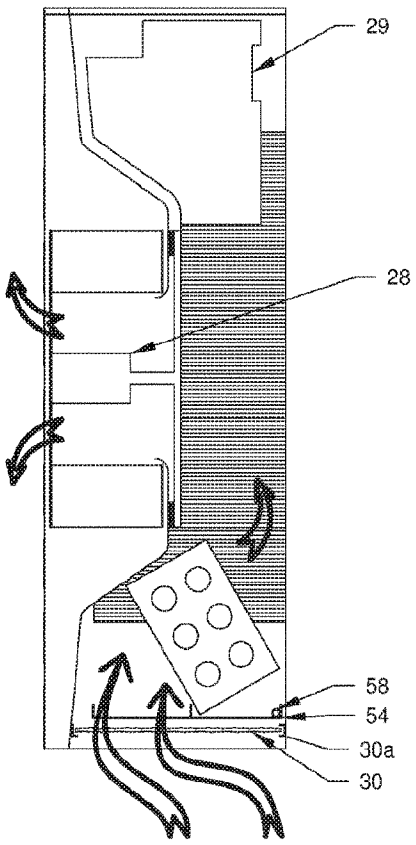
Fig 24B: Section B-B
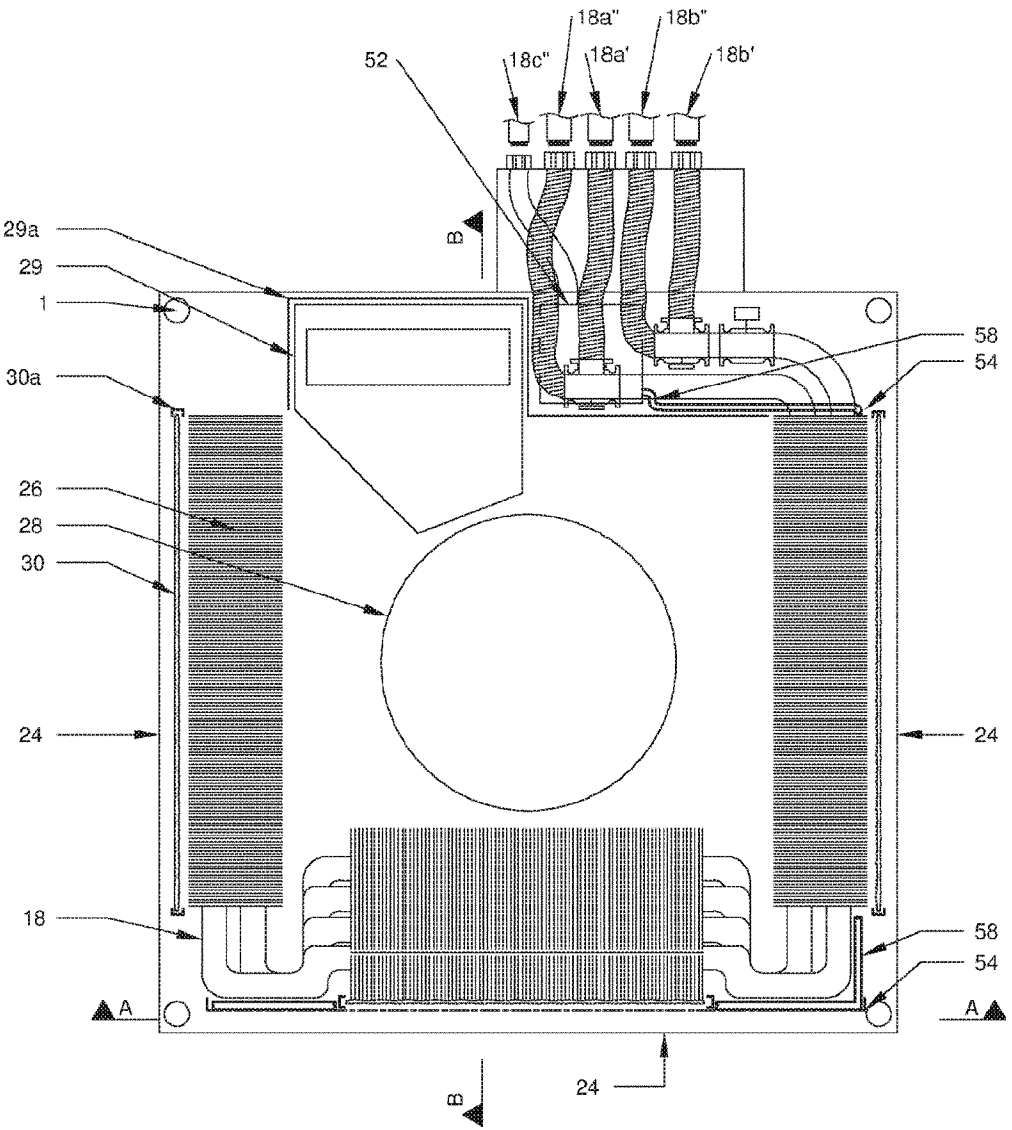
Fig 24A: Elevation

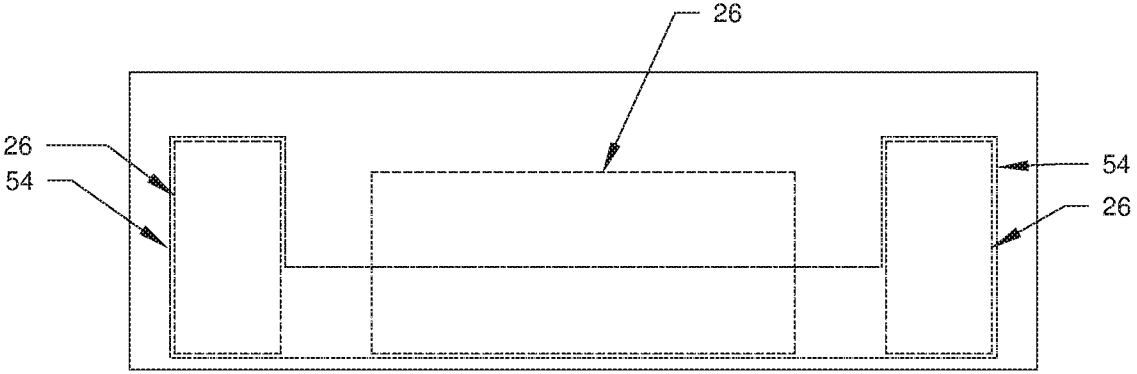
Fig 24C: Plan A-A

FAN AND AIR CONDITIONING UNIT COMPRISING THE SAME

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a novel fan and to an air conditioning unit comprising the same, in particular a low profile fan coil unit.

2. Description of Related Art Including Information Disclosed Under 37 CFR 1.97 and 37 CFR 1.98

Fan coil units are one of the most popular types of air conditioning unit in the world, and can be found in residential, commercial, and industrial buildings. A fan coil unit is essentially a device comprising a heating or cooling coil and a fan. Due to their simplicity, fan coil units are often more economical to install than ducted cooling and heating systems with air handling units. However, they can be noisy because the fan is within the temperature controlled space. Furthermore, if the fan coil unit or an 'all air' system is installed within a suspended ceiling, it can require large floor to floor heights to provide the space to accommodate the fan coil unit. They can also complicate maintenance as the suspended ceiling must be removed to access the unit.

A cassette air conditioning unit is a form of fan coil unit in which ceiling mounted cassettes are mounted in a ceiling void so that only a fascia is visible. The internal unit incorporates a cooling or heating coil and directional flaps allow air to be distributed around a room in 2, 3, or 4 different directions.

The present invention arose during the development of an improved fan for a fan coil unit which is described in WO 2016/016659 A1, the contents of which are incorporated herein by reference. The fan of the present invention is not limited to use in a fan coil unit and can be used in other applications.

A fan comprises a motor, an impeller, and a stator. A stator is the stationary part of the fan which interacts with an air flow passing through the impeller and, within the air flow passage defined between an air inlet and an air outlet, includes any part that may increase the fan efficiency and excludes any non-fan component that may decrease the fan efficiency. The stator does not obstruct air flow through an air flow passage since it does not reduce the efficiency of the fan. An impeller is a rotating device and comprises, for example, a hub and blades extending radially therefrom.

BRIEF SUMMARY OF THE INVENTION

According to the present invention in a first aspect, there is provided a fan comprising a motor, an impeller and a stator, the fan defining an air flow passage between an air inlet and an air outlet, wherein the fan has a mode of operation and an arrangement such that, in use, the trajectory of the air flow through the air inlet is up to 360° in a direction which is generally perpendicular to the axis of rotation of the impeller, the trajectory of the air flow through the air outlet is up to 360° in a direction which is generally perpendicular to the axis of rotation of the impeller, and the air flow through the air flow passage turns generally 180°.

The phrase 'generally 180 degrees' includes a turning angle in the range of 150 to 180 degrees. The phrase 'generally perpendicular' or 'generally 90 degrees' includes an angle which is within 30 degrees of perpendicular and is, for example, within 15 degrees of perpendicular.

The turning of the air flow through the air flow passage is achieved in the absence of obstructions, meaning that no guide vanes, deflectors, shrouds or backplates (for example) are present in the air flow passage. There is no forced redirection of the air flow.

The air flow in the air flow passage enters the fan through the air inlet in a first radial direction and exits the fan through the air outlet in a second radial direction. These first and second radial directions are preferably generally opposite to one another.

The trajectory of the air flow through the air inlet is preferably in the range of 180 to 360 degrees, more preferably 270 to 360 degrees, in a direction (or plane) which is generally perpendicular to the axis of rotation of the impeller.

The trajectory of the air flow through the air outlet is preferably in the range of 180 to 360 degrees, more preferably 270 to 360 degrees, in a direction (or plane) which is generally perpendicular to the axis of rotation of the impeller.

In one embodiment, air flow through the air outlet exits in a radial pattern in a direction which is up to 90° from the axis of rotation of the impeller.

The fan preferably has a radial outlet trajectory of up to 360 degrees. This radial outlet trajectory preferably rotates about the axis of rotation of the impeller. This rotation is preferably achieved by the mode of operation and the arrangement of the fan without the use of additional devices such as swirl diffusers or other deflectors.

In one embodiment, air flow through the air inlet enters in a radial pattern in a direction which is up to 90° from the axis of rotation of the impeller.

The fan preferably has a radial inlet trajectory of up to 360 degrees. This radial inlet trajectory preferably rotates about the axis of rotation of the impeller. This rotation is preferably achieved by the mode of operation and the arrangement of the fan without the use of additional devices such as swirl diffusers or other deflectors.

In a preferred embodiment, the fan is an axial fan.

Axial fans are designed such that the blades of the impeller force air to move parallel to the axis of rotation of the impeller, meaning that the air flow moves axially in and out of the fan (i.e. linearly).

Such fans are not operated so that they stall as this creates significant vibration and noise and renders the fan unstable.

However, the present inventor has discovered that operating a fan such as an axial fan within the stall region of the fan characteristic is beneficial in the context of the present invention.

Thus in a second aspect, the present invention provides, either in the second aspect alone or in combination with the first aspect, a fan comprising a motor, an impellor and a stator, wherein the fan has a mode of constant operation, and wherein, in this mode, the operating point of the fan falls within the stall region of the fan characteristic.

The constant mode of operation is a normal operating mode of the fan. The constant mode of operation does not mean that the fan is operating at a constant operating point and/or that the speed is not changing:the operating point of a fan will change depending on its installation and during use (for example, due to the degree of cleanliness of the filter): also the speed of the fan will change depending on demand (for example).

What is meant by a mode of constant operation' is that the fan is constantly in a mode whereby the operating point is a set point within the area of stall, as explained below with reference to FIG. 30*d* and area H.

The fan may operate in this constant mode of operation for an indefinite period of time or for a predetermined period of time. It may, for example, operate in this mode for any period of time over 10 seconds. The fan will operate in this mode at any time it is switched on (with the possible exception of any period at the start or end of its operation when the fan increases or decreases in speed).

The height of the stator may be chosen to facilitate the air to enter and leave the impeller within the confines of the space envelope of any desired application whilst at the same time maintaining a fan performance characteristic that is acceptable to the application, such as volume flow, pressure development and noise emission.

The path of air through the fan turns generally 180° without the use of guide vanes, deflectors, shrouds or back plates. The fan preferably comprises an axial fan where air typically may enter and leave the impeller along essentially cylindrical surfaces coaxial with the fan. In the present invention, whilst the fan may have physical characteristics associated with an axial fan, it provides an air path pattern that is similar to centrifugal or mixed flow fans. With reference to a rotational axis of the fan (being the axis of rotation of the impeller), the air enters at an angle generally perpendicular to the axis and exits at an angle generally perpendicular to the axis, with the air flow through the air flow passage turning generally 180 degrees. At the turning point only, the air may flow along substantially cylindrical surfaces coaxial with the rotational axis of the impeller. When viewed perpendicular to the axis, the inlet trajectory is preferably in a pattern that is up to 360° and the outlet trajectory is preferably in a pattern that is up to 360°. A radial air outlet pattern and/or a radial air inlet pattern may be formed that may also rotate with respect to the axis of rotation of the impeller.

The inlet and outlet flow trajectories and patterns allow for the integration into a compact appliance where the inlet condition is restricted and the outlet conditions are restricted or where a radial outlet encourages entrainment of air patterns within an exhaust area, zone or room.

The radial outlet effect may be achieved by an axial fan if used in the stall region of the fan characteristic: a constant mode of operation of the axial fan in this stall region is required to achieve a desired air flow pattern. Notably, as will be appreciated by those skilled in the art, any axial fan can be taken with any height of stator and the radial effect on the outlet will occur.

A radial outlet air flow pattern may be achieved (without any forced redirection) by adapting the design of the motor, the impeller and the stator. For example, by reducing the height of the stator (e.g. a wall-ring) to a height that is typically one half of that of the height of the impeller. Alternatively or in addition, by offsetting the position of the stator towards the outlet plane of the impeller, within the confines of the application into which it is integrated, so that the desired operating point of the fan falls within the stall region, and the resultant characteristic of volume flow, power consumption and noise are not adverse to the design limits. The outcome is a radial pattern of the outlet flow. In addition, there can be a radial pattern on the inlet flow of the air whereby the inlet and outlet air paths are at an angle of generally 1 80° degrees of each other and in opposite directions.

The height of the stator is its dimension parallel to the axis of rotation of the impeller. The height of the impeller is its dimension parallel to its axis of rotation and is the distance between the outermost tips of its blades: by way of example, when the impeller lies in a horizontal plane, the height of the impeller is the distance between the uppermost tip(s) and the lowermost tip(s) of its blades and excludes any additional height of the hub of the impeller. The height of the impeller is, therefore, the distance between the opposing faces of the impeller, as defined by the arrangement and dimensions of its blades.

In one embodiment, the height of the stator is substantially one half of the height of the impeller.

In the same or a different embodiment, the centre of the height of the stator is positioned offset from the centre of the height of the impeller: this offset position may be a distance of one third from one face of the impeller and one sixth from the opposite face of the impeller. When the impeller lies in a horizontal plane such that its axis of rotation is oriented vertically, this offset position may be a distance of one third from upper face of the impeller and one sixth from the opposing lower face of the impeller.

The stator preferably surrounds the periphery of the blades of the impeller such that the stator lies in a plane which is substantially perpendicular to the axis of rotation of the impeller.

According to the present invention in a further aspect, there is provided an air conditioning unit, comprising:a main body including an air inlet and an air outlet, the main body defines an airflow passage between the air inlet and the air outlet; a fan as defined above is disposed within the airflow passage; and a thermal element is disposed within the airflow passage upstream of the fan, wherein the main body has a first face on which the air outlet is disposed, and wherein the air inlet and thermal element are disposed at the periphery of the first face.

The air inlet and thermal element are preferably disposed only at the periphery of the first face.

With the air inlet and thermal element disposed at the periphery of the first face, there is provided an airflow velocity at the thermal element that is lower, for a given total airflow through the fan, than the airflow velocity at the thermal element in prior art arrangements where the air inlet and thermal element are central on the face of the unit/central within the body of the unit. A greater surface area is available at the periphery of the first face than at a more central location.

Preferably the air inlet and thermal element extend along at least 50% of the periphery of the first face, and more preferably at least 70% of the periphery of the first face. In preferred embodiments, the periphery of the first face may also include space for connections to building utilities such as electrical power and/or incoming/outgoing working fluid for the thermal element. It is preferred for the thermal element and air inlet to extend around the entirety of the available space about the periphery of the first face, which in the case above would be the space not required for connection to building utilities.

Preferably the air inlet, the air outlet and the airflow passage are arranged such that, in use, the airflow velocity through the airflow passage at the thermal element is less than 50%, preferably less than 30%, of the airflow velocity through the airflow passage downstream of the fan, e.g. at an output of the fan. Where there is relatively little pressure increase caused by the fan, this is approximately equivalent to the airflow passage cross-sectional area at the thermal element being at least twice, preferably at least three times, that of the airflow passage cross-sectional area at the output of the fan.

In a preferred embodiment, the air conditioning unit may be arranged such that, when the fan is driven to give an air output velocity of about 0.8 metres/second at the first face, the airflow velocity through the airflow passage at the thermal element is between 0.5 and 1.5 metres/second, and preferably about 0.5 to 0.7 metres/second. This is much lower than in most fan coil units, which operate at an air velocity of around 2.5 metres/second at the cooling coils.

This configuration, which takes advantage of the reduced airflow velocity at the thermal element discussed above, both reduces the pressure drop across the thermal elements and increases the thermal transfer rate between the thermal elements and the airflow. Hence, the heat transfer efficiency can be increased, whilst also reducing the work required to be performed by the fan.

The main body may comprise one or more second faces extending from the periphery of the first face, and the air inlet may be disposed on the second face(s).

The one or more second faces are preferably generally perpendicular (e.g. within about 30° of perpendicular) to the first face. The second face(s) hence may essentially be side faces of the unit, with the first face being a front face. Any number of side faces may be provided, for example where the main body is rectangular there will be four side faces. Other shapes may also be used, for example an air conditioning unit having a triangular shape would have three side faces.

The first face may be a front plate of the air conditioning unit. In this context, the front plate is the portion of the air conditioning unit facing into the temperature controlled space. Thus, preferably the first face is adapted so as to be exposed, in use, to a temperature controlled space.

In preferred embodiments, the first face of the air conditioning unit is rectangular, preferably having a width of less than 600 mm and a length of less than 600 mm. The main body of the air conditioning unit is preferably generally cuboid. This enables the main body to be conveniently installed in a standard ceiling grid. With a generally cuboid shape the second faces would be sides of the cuboid, extending away from the sides of the rectangular first face and being generally perpendicular to the surface of the first face.

Preferably the main body of the air conditioning unit has a thickness of less than 300 mm, more preferably less than 250 mm and most preferably 200 mm or less.

Conventional fan coil units have not been able to achieve such thicknesses. However, the arrangement of the present invention allows these low thicknesses to be achieved.

In some embodiments, the thermal element may comprise a thermal coil for heat exchange with air flowing across the coil, such as a water-cooled coil. This may be arranged either in a cooling only ('2-pipe') coil configuration or a cooling and heating ('4-pipe') coil configuration. The thermal element may further comprise heat exchange fins adjacent to the air inlet, so as to maximize heat transfer between the coil and the air.

In alternative embodiments, the thermal element may instead be a chilled beam for heat exchange with air flowing through the chilled beam.

Preferably the impeller is oriented such that a rotational axis of the impeller is substantially perpendicular to the first face. This allows a relatively large diameter impeller to be used without increasing the thickness of the main body of the unit (i.e. the distance from the front face to the rear of the main body). In some embodiments, the diameter of the impeller may be greater than 200 mm. It will be noted that the preferred placement of the impeller on the first face and at a centre of the unit allows for maximum space for a large diameter of impeller, without restricting the space available for the air inlet and thermal elements, which are at the periphery around the impeller.

The fan preferably vents air directly into the temperature-controlled space. This is contrary to the arrangement of most traditional fan coil units, where the fan vents the air through further downstream components, such as diffuser fins, secondary ducting, and so on.

The fan provides a swirl effect to the air output into the temperature-controlled space. That is to say, the air discharges straight from the tips of the blades of the impeller in a pattern that spreads out in a circular flow. Although a similar effect can be achieved in conventional units using a swirl diffuser, this causes energy loss as the airflow is redirected by blades. The swirl effect causes a high induction air flow, which is desirable because it can introduce cold air into a conditioned space with less risk of draughts. Using the fan to provide the swirl effect rather than a diffuser, or similar, minimizes changes in direction for the air, and minimizes energy loss.

The air conditioning unit, as detailed in any of the above statements, may be arranged to be mounted vertically, i.e. with the first face extending substantially vertically. In such a configuration, if the periphery of the first face includes space for connections to building utilities such as electrical power and/or incoming/outgoing working fluid for the thermal element, this space will be provided on an upper substantially horizontally extending peripheral side of the first face. The thermal element and air inlet will extend around substantially the entirety of the available space about the periphery of the first face, which in this case would be the space not required for connection to building utilities, i.e. the space about the lower substantially horizontally extending peripheral side and about the substantially vertically extending peripheral sides of the first face. In such an arrangement, the portion of the thermal element extending along lower substantially horizontally extending peripheral side of the first face may be provided at an oblique angle to the vertical/front face, preferably at an angle of around 30 degrees.

In one preferred embodiment, the thermal element is mounted to a first housing portion of the main body and the fan is mounted to a second housing portion of the main body, the second housing portion being hinged with respect to the first housing. As a result, the second housing portion may be rotatable via the hinge with respect to the first housing portion from a first position to a second position, wherein the fan is operable for normal use in the first position and is accessible for maintenance in the second position. Preferably the second housing portion includes the first face and is adapted so as to be exposed, in use, to the temperature controlled space.

Thus, the air conditioning unit may allow'self-access'. That is to say, components of the air conditioning unit requiring access (e.g. for maintenance), such as the fan and filters, can be reached simply by unlatching and rotating the second housing, rather than for example requiring removal of ceiling tiles and disassembly or removal of the fan coil unit, as is presently required. As the rotatable second housing portion remains attached to the rest of the unit, which is attached to the ceiling or other support, then maintenance can be carried out in situ without the need to disconnect the power supply or heat/cooling source.

The air conditioning unit may include an air filter in the airflow passage upstream of the fan, and preferably also upstream of the thermal element.

The filter is preferably arranged within the main body such that it cannot be removed from the main body when the second housing portion in the first position and can be removed from the main body when the second housing portion is in the second position. In some arrangements, the filter may be releasably mounted within the first housing portion.

The air conditioning unit preferably further comprises a drip tray arranged so as to be, in use, vertically below at least the thermal element. Where multiple thermal elements are provided, the drip tray will overlap with all of the vertical elements. The drip tray is thus configured to catch condensate that forms on the thermal element when operating in a cooling mode. When any of the thermal elements is provided at an oblique angle to the vertical, as for example when the air conditioning unit is arranged to be mounted vertically, the drip tray may only partially overlap with the angled thermal element to leave a free space for the flow of outside air to the angled thermal element through a lower horizontally extending second face. Condensate will run down the angled face to collect in the drip tray. The drip tray (or one or more additional drip trays) may also be provided under further chilled components of the air conditioning unit, such as cooling medium valves and pipes connecting to the thermal element.

The or each drip tray preferably contains a hydrophilic member, such as a tube formed of hydrophilic material, which is disposed within the drip tray to collect condensate caught by the drip tray. The use of a hydrophilic material allows water to be drawn into the material, avoiding the need for gravity drainage, which would increase the thickness of the air conditioning unit. Instead, the condensate can be drawn via the member along a drip tray that is substantially horizontal along its length, or even up a slight incline in situations where the air conditioning unit is not installed perfectly level.

The drip tray may have a sloped floor arranged to, in use, direct the condensate toward the hydrophilic member. This allows a smaller hydrophilic member to be used without significantly increasing the thickness of the unit. Preferably, the drip tray is elongated, and the slope is perpendicular to the longitudinal direction of the tray, i.e. so as to direct the condensate toward an elongate hydrophilic member running substantially the length of the drip tray. Preferably the drip tray is arranged so as to be substantially horizontal, in its longitudinal direction in use. As the air conditioning unit is preferably very thin, a steep gradient cannot be provided across the entire length of the drip tray to drain condensate to a single drainage location. Instead, a local gradient directs the condensate to the hydrophilic member, which collects the condensate.

The air conditioning unit may further comprise a pump arranged to draw the condensate along the hydrophilic member. In some embodiments, a moisture detector, such as moisture detection tape, may be provided adjacent to the hydrophilic member, and the pump may then be arranged to activate when moisture is detected by the moisture detector. Thus, when the hydrophilic member is saturated with condensate, the unabsorbed moisture will be detected and the pump will activate, e.g. for a predetermined period of time, to drain the moisture absorbed by the hydrophilic member. This then minimizes the time the pump is active, reducing the energy required for the pump and any pump noise. The pump will be arranged to have minimal noise when running.

The air conditioning unit preferably further comprises: an installation frame adapted to be mounted to the ceiling during a first fix and comprising isolatable connections for services of the air conditioning unit to be connected, wherein the main body is adapted to be mounted to the installation frame during a second fix.

By this arrangement, the installation frame can be installed during the first fix and the services, such as power lines, control lines and/or cooling/heating medium pipework, can be connected to the isolatable connections. Then, at a later time during a second fix, the main body of the air conditioning unit can be installed. This means that workflow can be optimized as the various services need merely be connected to the installation frame when they are installed in the ceiling. This is more efficient than fitting them all at the same time as the air conditioning unit is installed, as it gives flexibility for different trades to attend to make connections at different times.

In one embodiment, a method of installing the air conditioning unit comprises: fixing the installation frame to a ceiling; installing ceiling services, terminating at the isolatable connections of the installation frame; installing a suspended ceiling; and mounting the main body of the air conditioning unit onto the installation frame.

In some embodiments, the air outlet may be adapted to receive a light emitting device. That is to say, it may include for example light fittings for lamps to be inserted. The output air is then output around the light allowing the air conditioning unit to provide a dual function. The air outlet may further be arranged to act as a light diffuser for the light emitting device.

In some embodiments, the air conditioning unit may be adapted to be suspended from a ceiling, for example as a pendant. This may be appropriate for retail use, or restaurants, with exposed ceilings. There is also a move in office design towards removing suspended ceilings and having exposed services and suspended units. In such an embodiment, the main body may include second faces that are hinged to permit access.

Where the air conditioning unit is adapted to be suspended, the unit may further comprise a rim member surrounding the main body. Preferably rim member has an outer edge having a height less than 60% of the thickness of the main body. The rear of the rim member will be hard to see from below, this giving the illusion of a slim unit.

The rim member may include additional services, such as lights, fire detectors, sprinklers, public announcement facilities, and so on, thus allowing the air conditioning unit to act as a multiservice unit.

An embodiment of invention can also be seen to provide a structure including the air conditioning unit, wherein the structure comprises a floor, a ceiling and a temperature controlled space defined between the floor and the ceiling, and wherein the main body of the air conditioning unit is disposed within a ceiling void of the ceiling such that the first face is exposed to the temperature controlled space.

In some embodiments, the structure is arranged such that air is drawn into the temperature controlled space via a floor void of the floor.

An alternative embodiment of the invention can be seen to provide a structure including the air conditioning unit, wherein the structure comprises a floor, a ceiling, a vertical wall and a temperature controlled space defined between the floor, the ceiling and the wall, and wherein the main body of the air conditioning unit is disposed within the vertical wall such that the first face is vertical and exposed to the temperature controlled space. The vertical wall may include a void adjacent the air inlet of the air conditioning unit, the cavity being in gaseous communication with the temperature controlled space.

In this arrangement, the vertically-mounted air conditioning unit can be installed into a wall. The low profile of the air conditioning unit enables it is be installed in the wall without unduly limiting the space within the room. This configuration may be particularly well suited to a small computer room, such as an SER (Small equipment Room) or SCR (Sub Comms Room).

BRIEF DESCRIPTION OF THE SEVERAL VIEWS OF THE DRAWINGS

Certain preferred, non-limiting embodiments of the present invention will now be discussed in greater detail, by way of example only and with reference to the accompanying drawings.

FIG. 24A shows a sectional front view through yet another alternative air conditioning unit, which is arranged to be vertically mounted.

FIG. 24B shows a sectional side view of the air conditioning unit of FIG. 24A.

FIG. 24C shows a sectional plan view of the air conditioning unit of 24A, which shows detail of a condensate removal system therein.

DETAILED DESCRIPTION OF THE INVENTION

With reference to FIGS. 26 to 33 there is shown, schematically, a fan according to the present invention. The fan comprises an impellor 802 with blades 803, a stator 804 and a motor 806.

The fan defines an air flow passage between an air inlet and an air outlet, wherein the fan has a mode of operation and an arrangement such that, in use, the trajectory of the air flow through the air inlet is up to 360° in a direction which is generally perpendicular to the axis of rotation of the impeller, the trajectory of the air flow through the air outlet is up to 360° in a direction which is generally perpendicular to the axis of rotation of the impeller, and the air flow through the air flow passage turns generally 180°.

Figure 26A:
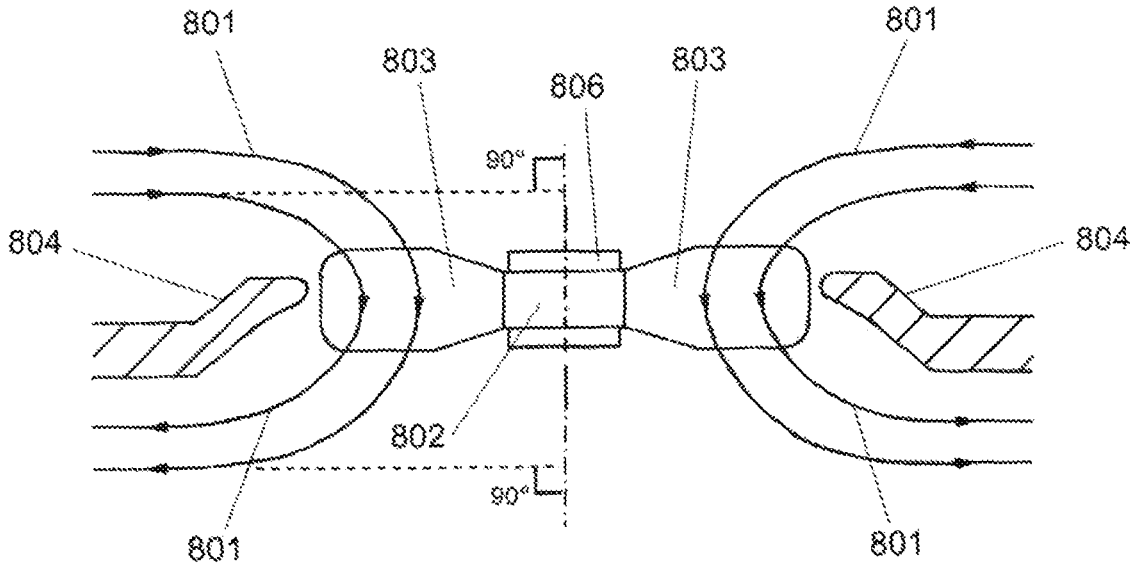
FIGS. 26*a* and 26*b* show a schematic cross-sectional side view of a fan according to an embodiment of the present invention with an airflow pattern illustrated.
Figure 26B:
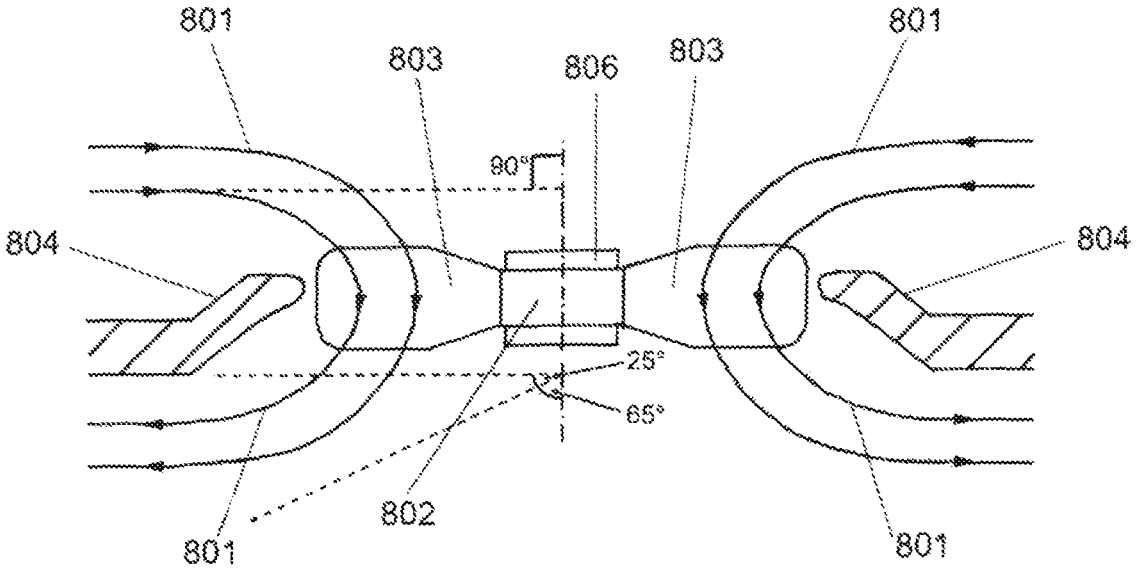

FIGS. 26*a* and 26*b* show the airflow pattern 801 arising when the fan is in use. The air flows from the air inlet in a direction which is generally perpendicular to the axis of rotation of the impeller towards the impeller blades. The air flow then turns though about 180 degrees towards the air outlet in a direction which is generally perpendicular to the axis of rotation of the impeller. At the turning point only, the air flows along substantially cylindrical surfaces coaxial with the axis of the impeller. FIG. 26*b* shows an angle of 65 degrees to a lower face of the impeller as the air flow turns towards the air outlet, by way of example. This angle may be 60 to 90 degrees, preferably 75 to 90 degrees. In the embodiment of FIGS. 26*a* and 26*b*, the air flow turns around the edge of the stator. The air flow may flow along one (upper) surface of the stator towards the impeller and, after turning, flow along an opposing (lower) surface of the stator away from the impeller.

The fan has a mode of constant operation in which the operating point of the fan falls with the stall region of the fan characteristic.

A radial outlet airflow pattern is achieved (without any forced redirection) by adapting the design of the motor, the impellor and the stator, within the confines of the application into which it is integrated, so that the desired operating point falls within the stall region, and the resultant characteristic of volume flow, power consumption and noise are not adverse to the design limits. The outcome is a radial pattern of the outlet flow. In addition, there can be a radial pattern on the inlet flow of the air whereby the inlet and outlet air paths are at an angle of substantially 180° degrees of each other and in opposite directions. It is a design of high airflow and low-pressure development.

With reference to the graphs presented in FIGS. 30*a* to 30*d*, the fan characteristic and the stall region are now explained. Such principles will be readily understood by those skilled in the art.

Figure 30A:
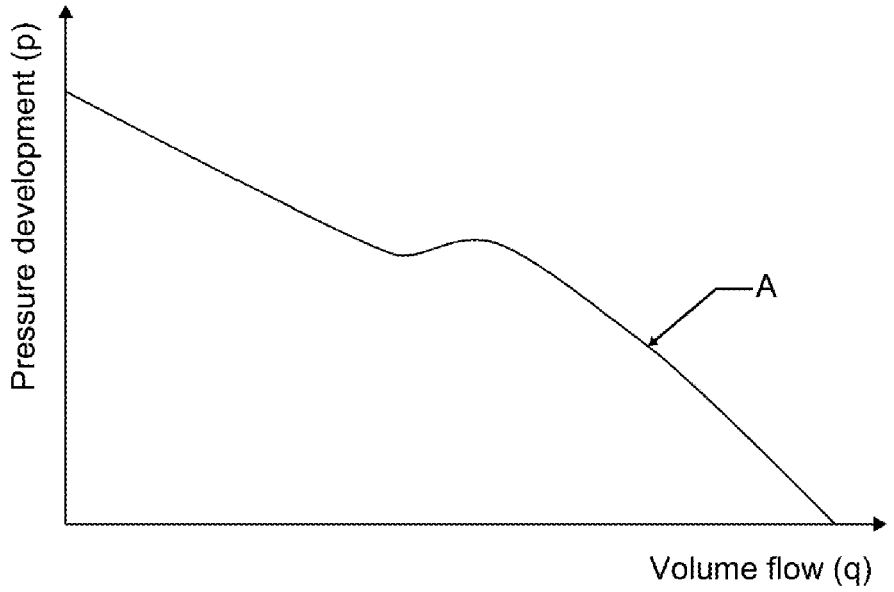
FIGS. 30*a* to *d* show example graphs of pressure development against volume flow for axial fans, illustrating the principles of fan characteristic and stall region.

The fan characteristic A is the relationship between the volume flow q compared to the pressure development p produced by the fan, as illustrated in FIG. 30*a*. The pressure development is used to overcome losses of the system into which it is integrated. Those losses are for example the resistance to the passage of air through filters and heating and cooling coils. The resistance is typically expressed as pressure loss in Pascals (Pa). As the resistance to flow increases the less volume flow the fan can deliver. Volume flow q is typically expressed in cubic metres per second ($m^3/s$) or litres per second (l/s).

Figure 30B:
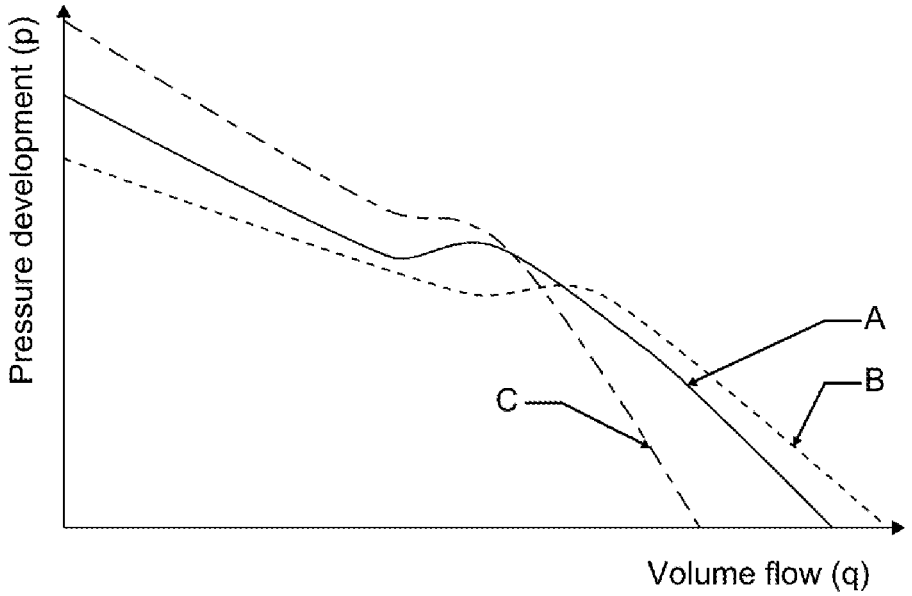

The shape of the fan characteristic A can be modified by changing one or more of the motor 806, impellor 802 or stator 804 (the significant elements). The stator may take the form of an orifice, a radius plate, a wall-ring or a wall-plate, for example. A change in either the impeller geometry (diameter, width, curvature, shape and/or pitch) or in stator geometry (diameter, inlet or outlet curvature and/or height of the stator) will result in a new fan characteristic, for example B or C, as indicated in FIG. 30*b*. The magnitude of the characteristic can be changed by varying the rotational speed of the impeller, for example with an impeller directly coupled to a motor, by changing the speed of the motor rotational speed. Reducing the speed reduces the volume flow and pressure development, for example changing the fan characteristic from A to F, as seen in FIG. 30*c*.

Figure 28:
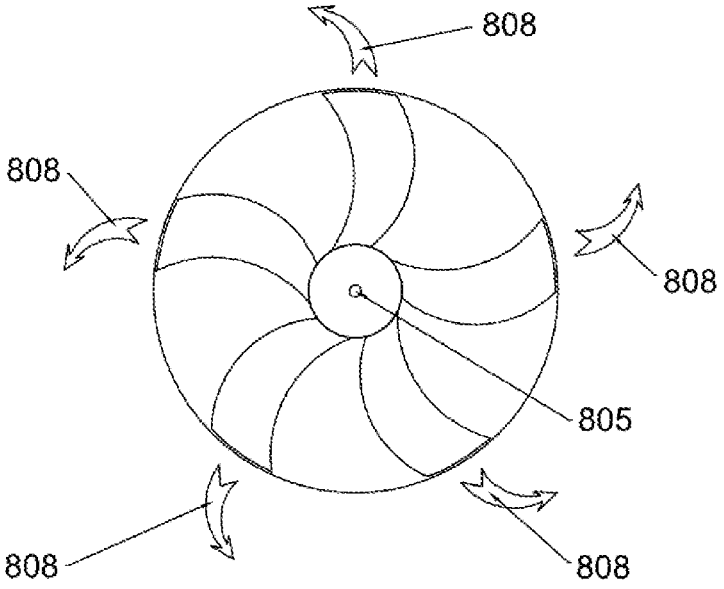
FIG. 28 shows a schematic plan view illustrating airflow on an outflow side of the fan.

The stall region of the fan characteristic is an area of instability where typically there is an increase in noise and mechanical vibration due to fluctuating forces. The stall region can sometimes be seen as a change in the fan characteristic curve, E and G, as seen in FIG. 30*c*. It is normal practice to avoid operation in this region to prevent unwanted noise and more importantly to avoid component failure due to the vibration. The stall region can be imagined as an area H, as shown in FIG. 30*d*, encompassing the minimum and maximum fan characteristic with relationship to the impeller rotational speed. Another effect within the stall region is the change in airflow direction of an axial fan. The normal direction is one where the air enters and leavers the impeller along essentially cylindrical surfaces coaxial with the fan. When in and above the stall area the outlet airflow becomes radial, as shown in FIG. 28.

Figure 30C:
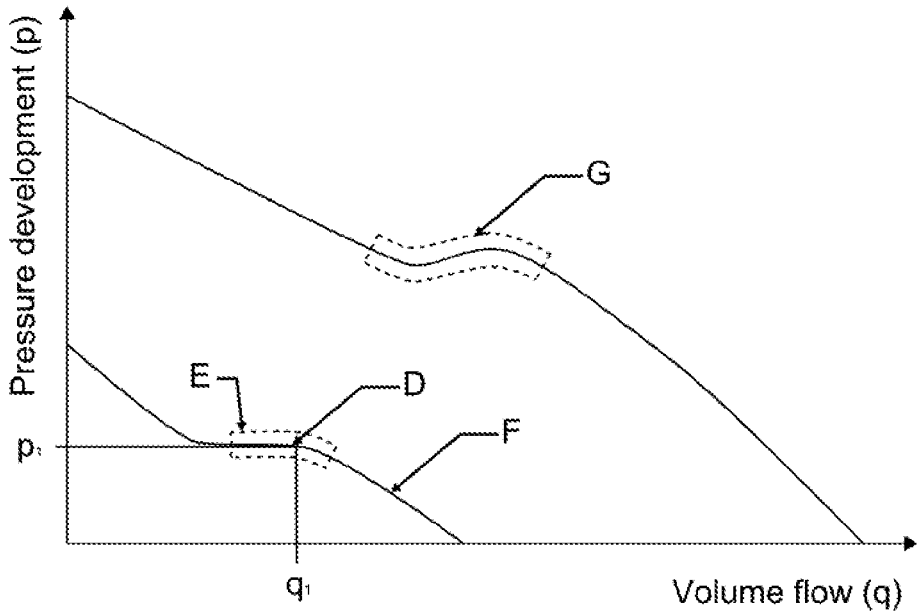
Figure 30D:
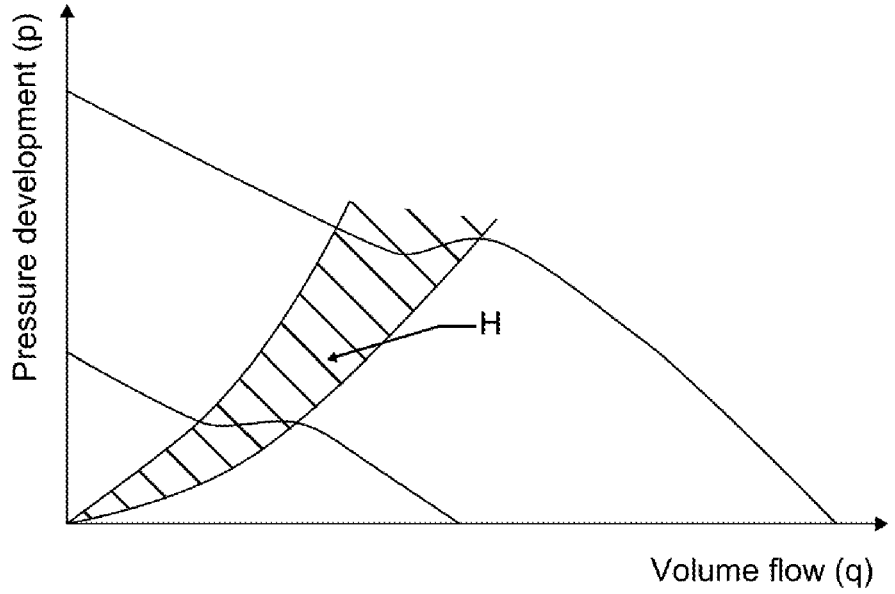

The duty point is the point of the pressure loss p1 of the system at the required volume q1, as seen in FIG. 30*c*. If the volume flow is increased then the resistance to the flow, pressure loss, increases, typically in a square law characteristic (assumed turbulent flow condition).

The invention seeks to provide the optimum application and combination of impeller geometry, stator geometry and the rotational speed of the impeller so that the stall region of the resultant fan characteristic aligns with or is lower than the duty point of the application, i.e. the duty point is within or above the stall area. As will be appreciated from the above discussion, a range of embodiments according to the invention could readily be provided in which the unstable airflow produces vibrations and noise of such low magnitude they are not of concern or heard by the human ear, but the resultant radial airflow pattern is advantageous.

It is on this principle that exemplary air conditioning units comprising the fan have been produced.

Figure 29:
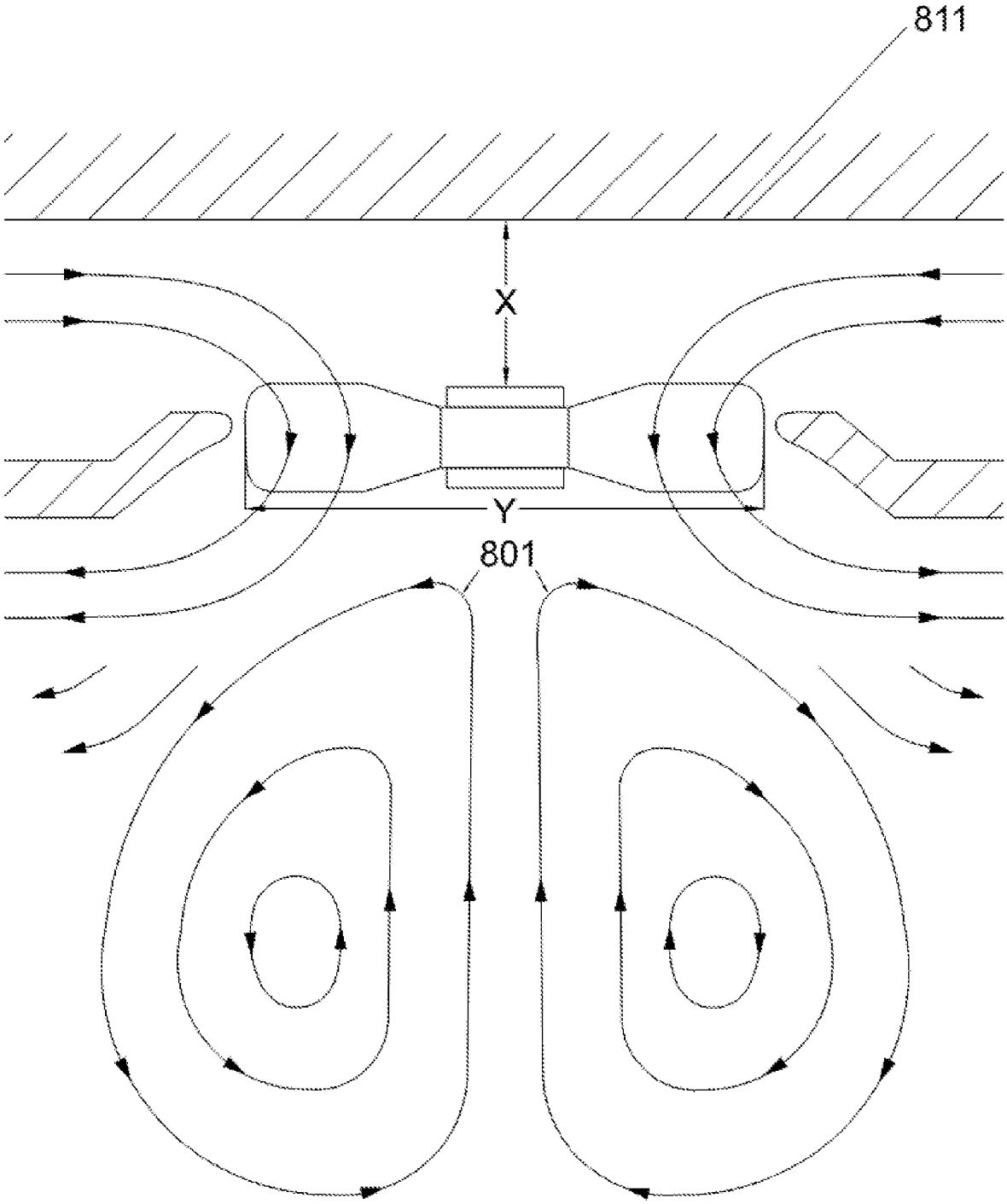
FIG. 29 shows a schematic cross-sectional side view of the fan of FIG. 26 in an air conditioning unit with the airflow pattern illustrated.

An exemplary air conditioning unit, taking the form of a compact fan coil unit having a low height, such as is described in detail with respect to FIGS. 1 to 25, is shown, schematically, in FIG. 29. There is a wall 811, for example an outer casing of the unit located flush to the underside of an upper floor or roof, which may be located a distance X that is less than half the diameter Y of the impeller. The inlet to the unit is at generally 90° to the rotating axis of the impeller.

Figure 27:
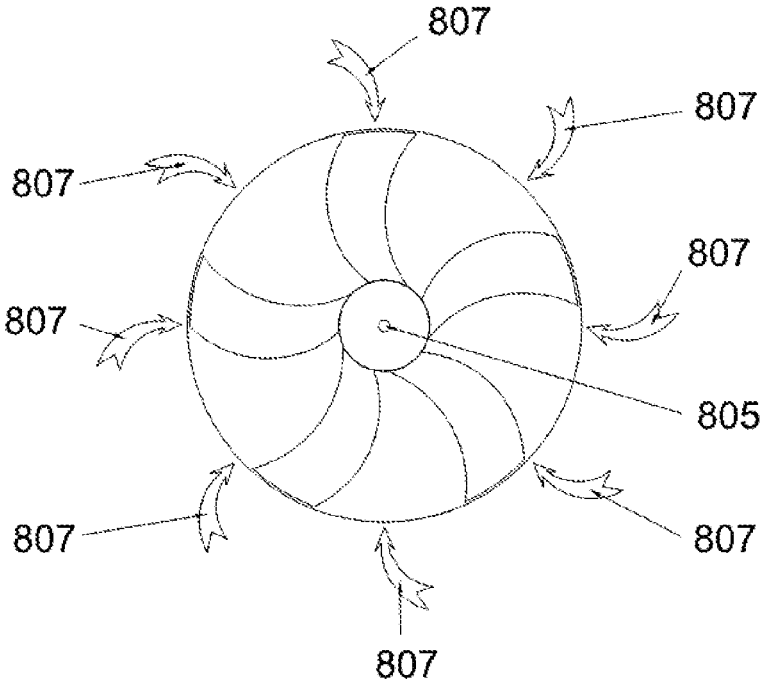
FIG. 27 shows a schematic plan view illustrating airflow on an inflow side of the fan.

FIG. 27 shows a radial air inlet pattern where the trajectory of the airflow 807 through the air inlet is up to 360° when viewed perpendicularly to the axis of rotation 805 of the impeller.

FIG. 28 shows a radial air outlet pattern where the trajectory of the airflow 808 through the air outlet is up to 360° when viewed perpendicularly to the axis of rotation 805 of the impeller.

By use of a fan operating on the above principles, providing the depicted airflow pattern, a swirl diffuser or other deflector, is not required, thus providing a more compact unit. In addition, the effect of the swirl diffuser is obtained by the air trajectory leaving the fan at generally 90° to the rotating axis 805 of the impeller and in a pattern that is of up to 360° as indicated at 808 (see FIG. 28). It can also be rotating with respect to the axis 805. This outlet pattern will travel for some distance along the underside of the ceiling (so called coanda effect) assisting, by entrainment, in the formation of large swirling masses of air within the room that facilitates in the mixing of the cold/warm air, as shown by airflow 801 in FIG. 29.

Figure 31:
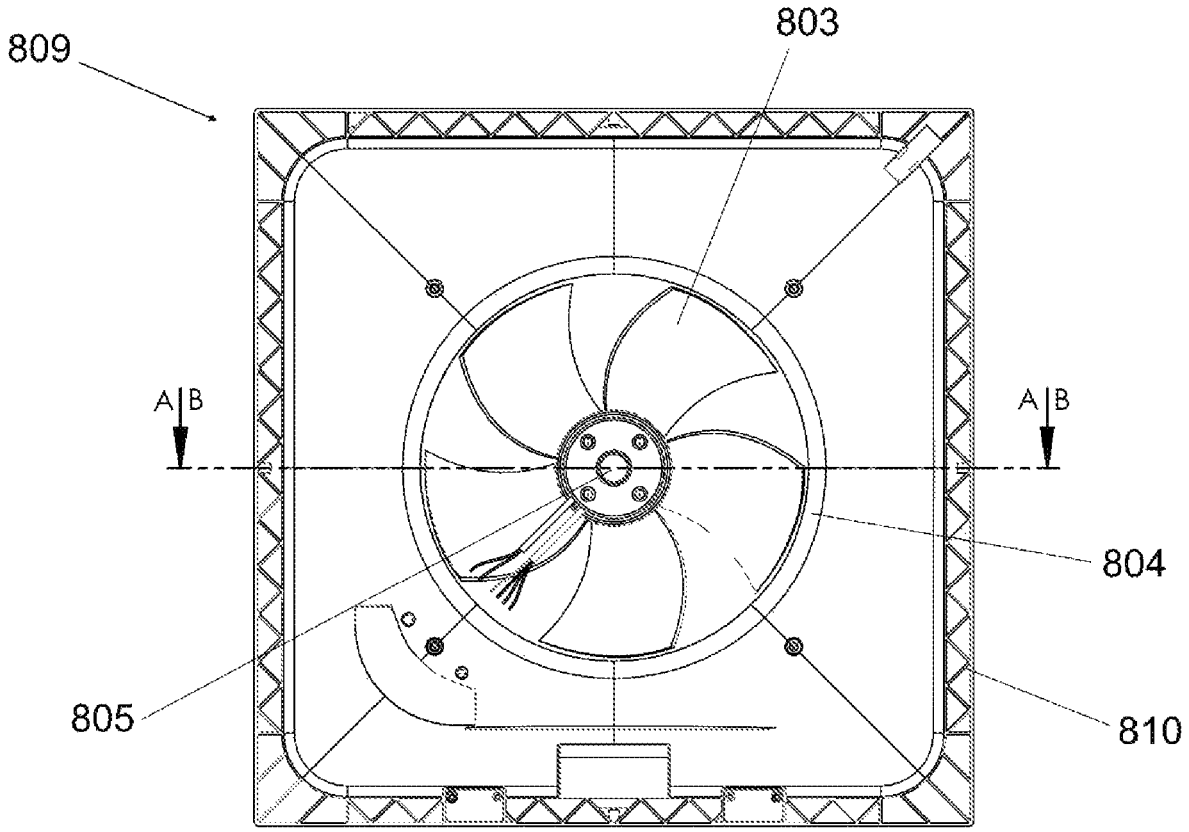
FIG. 31 shows a schematic cross-sectional plan view of a fan in an air conditioning unit.
Figure 32:
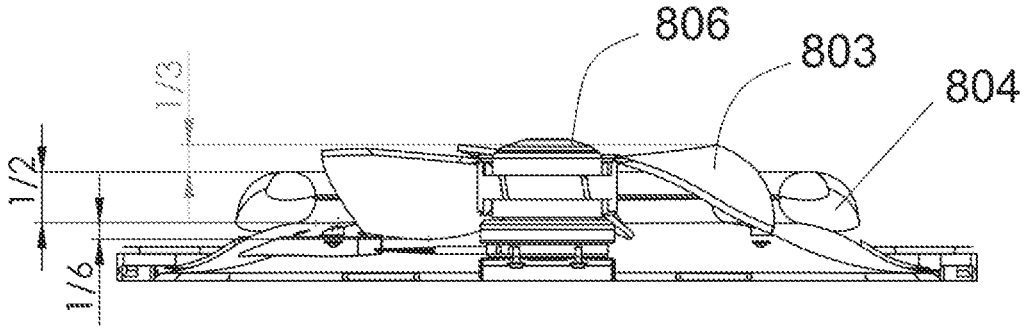
FIG. 32 shows a schematic partial cross-sectional side view taken along line AB-AB of the fan of FIG. 31 with relative dimensions shown.
Figure 33:
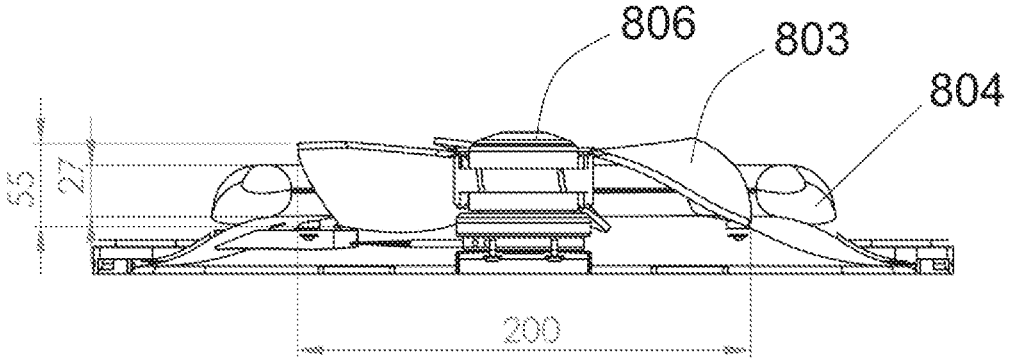
FIG. 33 shows a schematic partial cross-sectional side view taken along line AB-AB of the fan of FIG. 31 with example dimensions stated.

Referring to FIGS. 31 to 33, example dimensions and example relative dimensions are shown. It can be seen that the stator 804 surrounds the periphery of the blades 803 of the impeller 802 such that the stator lies in a plane which is substantially perpendicular to the axis of rotation 805 of the impeller. The stator is surrounded by the frame of an air conditioning unit 809 containing thermal elements 810. The stator envelops the height of the impeller (at least in part) and guides air in the air flow passage.

The height of the stator is its dimension parallel to the axis of rotation of the impeller. The height of the impeller is its dimension parallel to its axis of rotation and is the distance between the outermost tips of its blades (e.g. the distance between the uppermost tip(s) and the lowermost tip(s) of its blades) and excludes any additional height of the hub of the impeller. The height of the impeller is the distance between the opposing faces of the impeller.

In this example, the height of the stator is substantially one half of the height of the impeller.

Also in this example, with reference to FIG. 32, the centre of the height of the stator is positioned offset from the centre of the height of the impeller: this offset position is, for example, a distance of one third from the upper face of the impeller and one sixth from the opposing lower face of the impeller.

In the example of the fan coil unit shown, with reference to FIG. 33, the fan impeller diameter is 200 mm, the height of the impeller is 55 mm and the height of the wall ring (stator) is 27 mm and the wall-ring if offset in the ratios described above.

With reference to FIGS. 1 to 25 there are shown exemplary air conditioning units that comprise fans in accordance with those discussed with reference to FIGS. 26 to 33.

It must be noted that fans in accordance with the present invention, whilst ideally suited to use in air conditioning units, as discussed below, will find application in numerous alternative applications, as will be readily appreciated by those skilled in the art.

Figure 1:
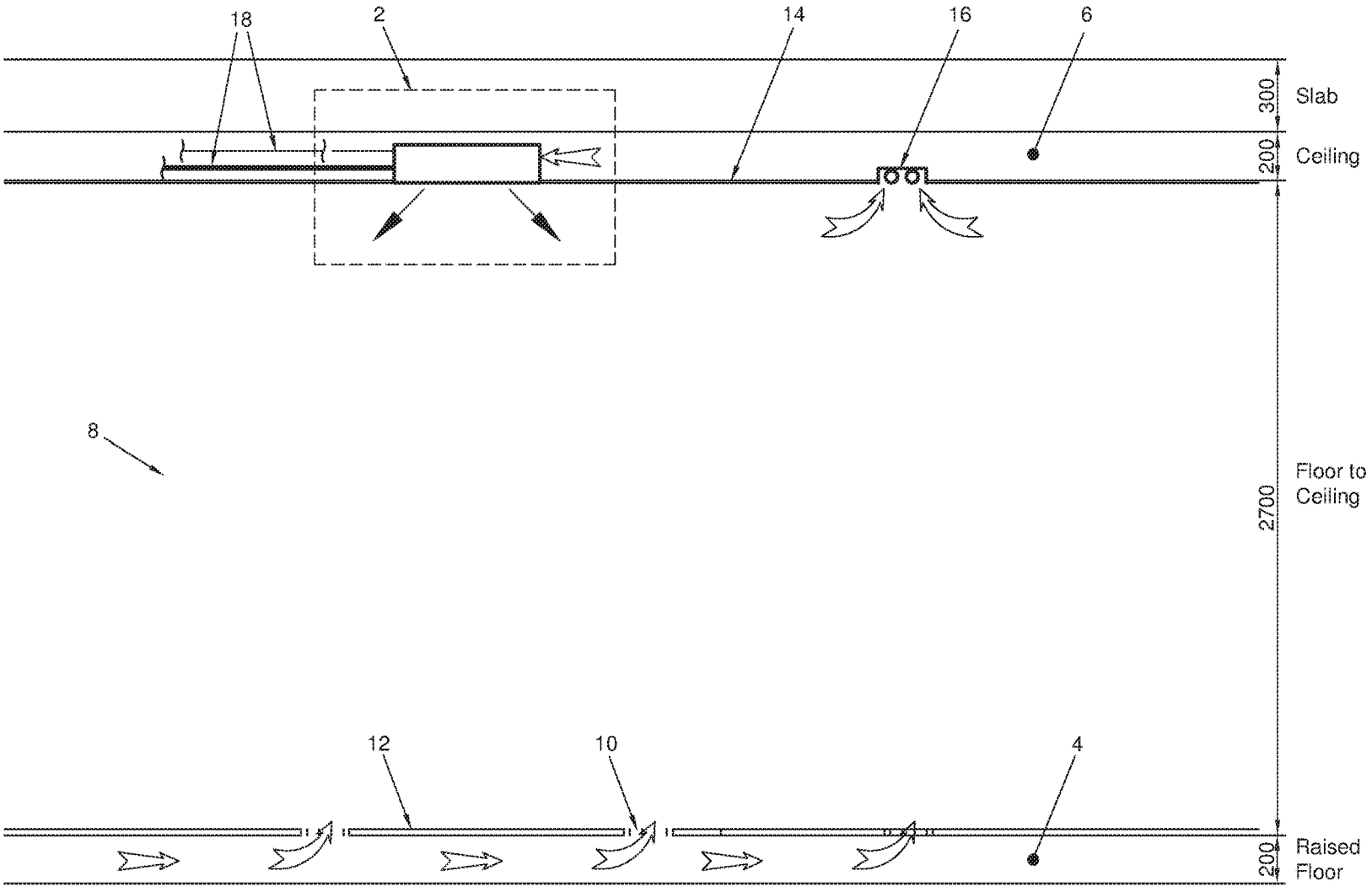
FIG. 1 shows a cross sectional view through a building illustrating airflow from an air conditioning unit.

FIG. 1 shows a cross section through an exemplary building illustrating airflow through an air conditioning unit 2. It should be noted that whilst the detailed description herein focusses on the use of such air conditioning units in buildings, they may equally be suitable for transport applications, such as coaches and railway carriages, or otherwise, due to their low height. The building uses a floor plenum 4 to provide an outside air supply and a ceiling plenum 6 for air extraction. Outside air enters a temperature controlled space 8 from the floor plenum 4 via floor outlets 10 formed in a raised floor 12. Air is circulated within the space 8 and is eventually extracted through a suspended ceiling 14 into the ceiling plenum 6 via ceiling openings 16, such as via the light fittings, as illustrated in FIG. 1.

This arrangement may not suit some projects, for example where smoke extract ductwork is required, but is intended to illustrate one exemplary configuration. Depths of 200 mm are suitable for each of the supply and extract plenums 4, 6, based on an assumed travel distance of 20 to 30 metres from the air supply in a central core of the building to the perimeter of the plenum 4, 6.

The shallow depth of the ceiling void 6 will require careful co-ordination of pipework, cables and other services. As shown, services 1 8 for the air conditioning unit 2 are delivered to and from the air conditioning unit 2 within the ceiling void 6. Such services 1 8 include cooling/heating liquid medium, e.g. chilled or heated water, power and control supplied to the air conditioning unit 2 and condensed water and return refrigerant from the air conditioning unit 2.

The air conditioning unit 2 is designed so as to achieve the same comfort quality standards as conventional air conditioning systems, e.g. fan coil units, chilled beams, chilled ceilings, VAV boxes, etc., whilst being only 200 mm high. It could save typically 300 mm on each story height of a building. For a building where the height is limited to 45 metres (approximately 12 stories at 3.7 m floor to floor height), this would add one floor within the same overall building height.

Furthermore, the air conditioning unit 2 does not require an accessible ceiling and can instead fit in the narrow 200 mm ceiling void 6 discussed above. Also, compared with a conventional fan coil system there is no secondary ductwork, and potentially far less primary ductwork.

As will be discussed below, the ductwork and pipework for the air conditioning unit 2 can be installed as part of first fix, and then a main body 3 of the air conditioning unit 2 including the fan 28 and coils 26 can be installed during a second fix, before or after the suspended ceiling 14 is installed. Commissioning, maintenance, and even unit replacement can be carried out after the ceiling 14 is installed.

Figure 2:
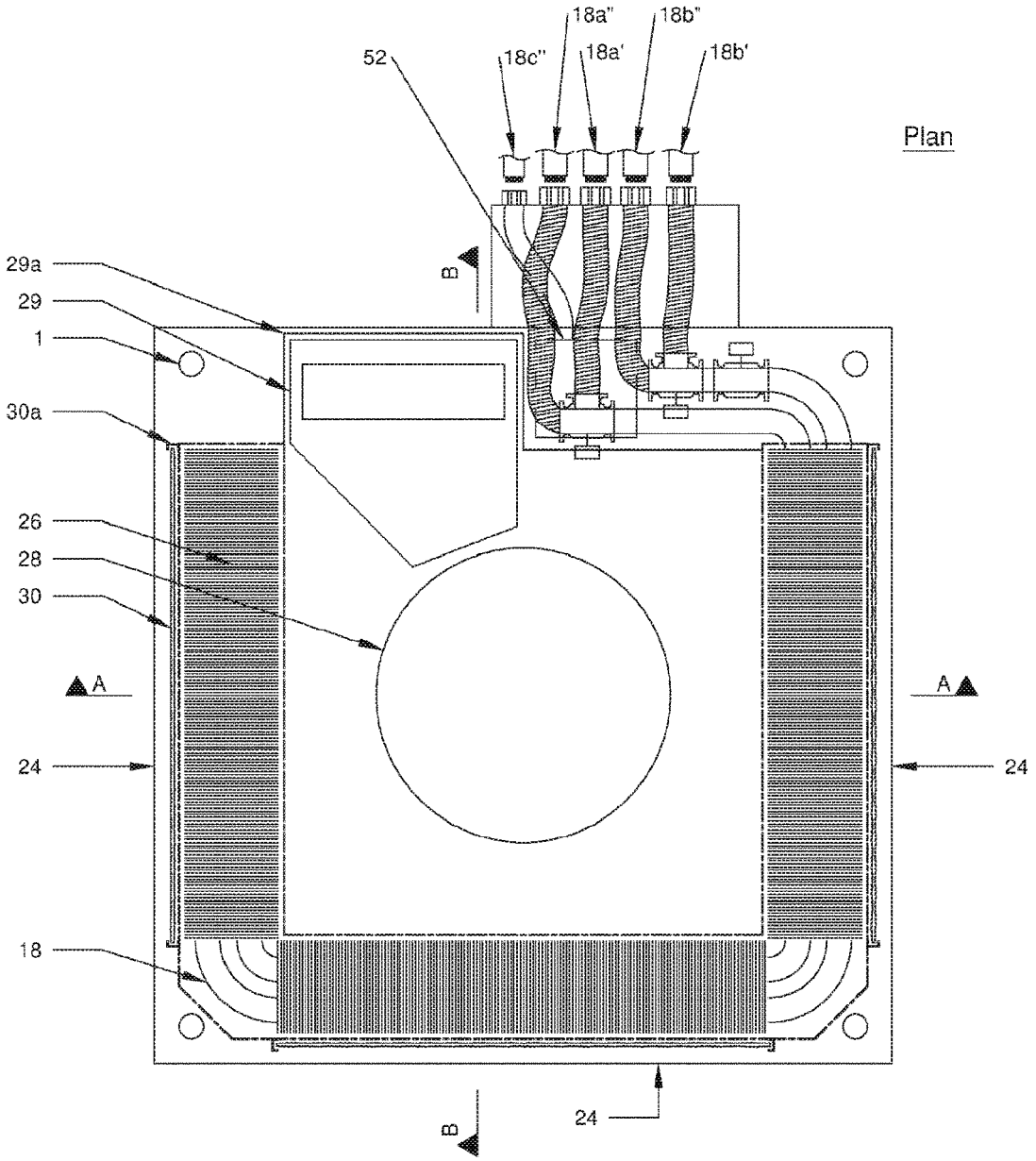
FIG. 2 shows a sectional plan view of a main body of the air conditioning unit of FIG. 1.
Figure 3A:
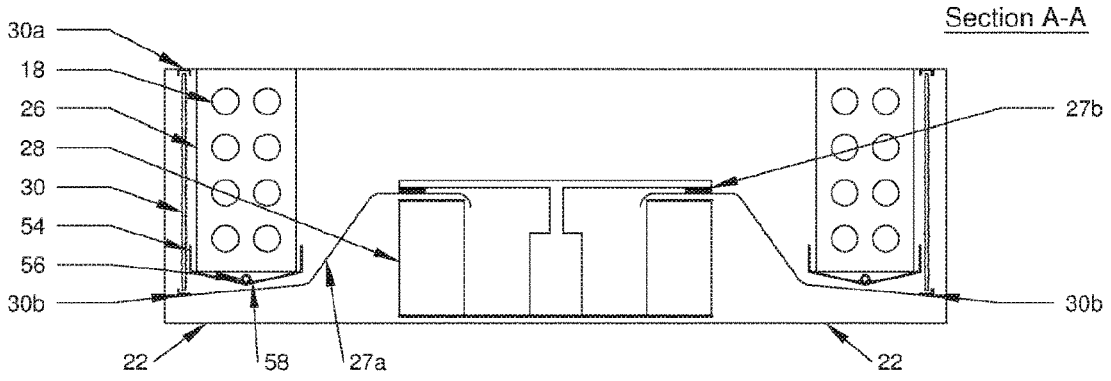
FIGS. 3A and 3B show cross sectional views of the main body of the air conditioning unit of FIG. 1, taken along section lines A-A and B-B in FIG. 2, respectively.
Figure 3B:
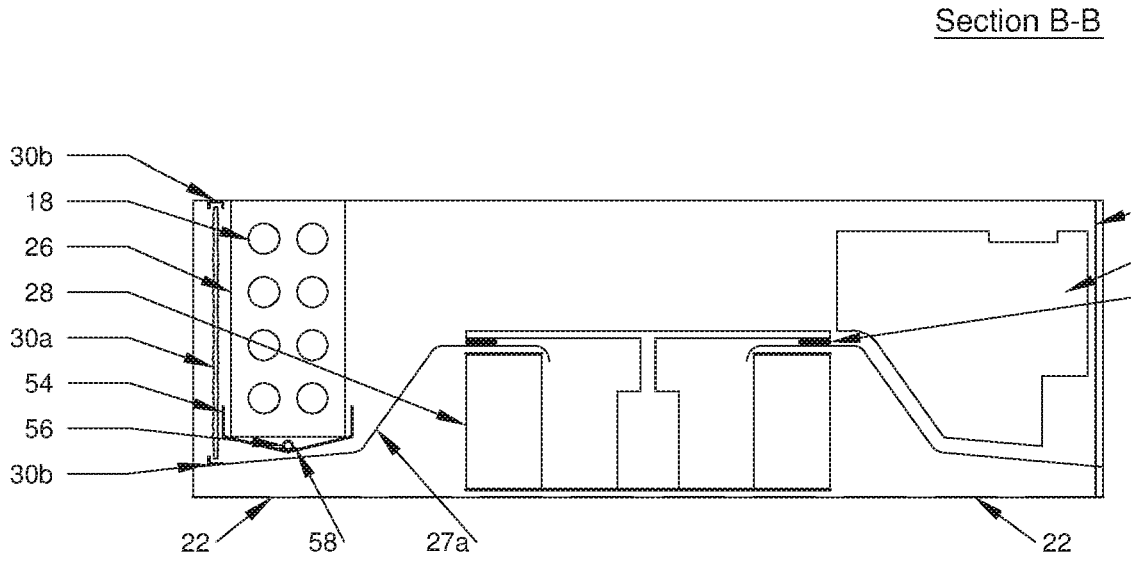

FIG. 2 shows a sectional plan view, of a main body 3 of the air conditioning unit 2 shown in FIG. 1. FIGS. 3A and 3B show cross-sectional views of the main body 3 taken along section lines A-A and B-B.

The air conditioning unit 2 is defined by a main body 3 having a front face, a rear face, and four side faces. The front and rear faces of the main body 3 are generally parallel to one another and the side faces are generally perpendicular to the front and rear faces. Suitable fixing means 1, which may comprise threaded rods, are preferably provided for suitably installing the air conditioning unit 2. When installed, the front face is exposed to the temperature controlled space 8.

The front face is substantially square having dimensions of about 600 mm×600 mm, which is sized to fit a standard ceiling grid (although other shapes and/or dimensions could of course be utilized). The unit has a height of about 200 mm between the front and rear faces.

The front face comprises a facia plate 20 having air outlets 22 through which conditioned air is directly injected into the temperature controlled space 8, i.e. there is no secondary ductwork. The air outlets 22 may comprise perforations in the facia plate and, at the outlets 22, the facia plate 20 is preferably at least 50% perforated. The side faces comprise air inlets 24 through which air is drawn into the air conditioning unit 2. The air inlets 24 are not usually visible during normal operation and so may simply comprise openings, but a filter 30 or the like may also be used to prevent large debris entering the unit 2, if desired.

Between the air inlets 24 and the air outlets 22 there is an airflow passage through which the air flows and is conditioned. In this arrangement, the airflow passage is defined by a stator 27*a* separating the air flowing into the fan/impeller 28 from the air being output by the fan 28.

Within the main body 3 is provided one or more thermal element 26 to heat and/or cool the air in the airflow passage and a fan 28 to drive the air. The thermal elements 26 are provided upstream of the fan 28. Also, within the main body 3 may be provided a plurality of air filters 30. The air filters 30 are disposed upstream of the thermal element 28. An air filter 30 and a thermal element 26 are provided adjacent to each air inlet 24. The air filters 30 are preferably retained by respective air filter guides 30*a* at their upper and side edges. The air filters 30 are retained in position by a clip at their lower edge.

The air inlets 24 are provided on three of the four sides of the air conditioning unit 2. It is desirable to maximise the air inlet area so as to minimise the airflow velocity over the thermal elements 26. However, some space must be left for the services 1 8 to enter the unit. Thus, it is not possible for the inlets 24 to cover more than about three and a half of the sides (less than about 90% of the periphery of the air conditioner unit 2). However, the air conditioner unit 2 would of course still operate with a smaller number of inlets 24, for example air inlets 24 could be provided on only two sides, i.e. along at least 50% of the periphery of the air conditioner unit 2.

A baffle plate 29*a* is provided on the fourth face of the air conditioner unit, which wraps round the fan control unit 29 and condensate pump 52, and prevents air from being drawn in, which would bypass the thermal elements 26.

By providing the air inlets 24 about the periphery of the air conditioner unit 2, the inlet area can be maximised. In this air conditioning unit 2, the air travelling across the thermal element 26 travels at approximately 0.6 to 1.0 metre/second, which is significantly lower than in conventional fan coil units, where there air speed at the thermal element 26 is about 2.5 metres/second. This improves heat transfer to or from thermal element 26 and reduces the pressure drop across the thermal element 26, allowing a smaller fan 28 to be used and hence allowing the air conditioner unit 2 to be made thinner than traditional fan coil units where the air would be drawn in at the centre at relatively high speed.

During operation, air enters the air conditioner 2 substantially horizontally through the air inlets 24 into the airflow passage. The air continues substantially horizontally through one of the air filters 30 and across a region of the thermal element 26. The air is then drawn vertically downwards into the fan 28 and ejected directly out of the air conditioning unit 2 via the air outlets 22 into the temperature controlled space 8.

The air conditioning unit 2 may include turning vanes (not shown) on the approach to the fan 28 to smooth the airstream and reduce friction. The arrangement shown in FIG. 2 is equivalent to a 90 degree bend via a plenum. Installing turning vanes in this location may reduce the pressure drop for this bend to 50% of the pressure drop for a plenum arrangement (i.e. without any turning vanes).

The impeller is driven by a motor (not shown), which may be a DC motor to give good energy performance and variable speed capabilities.

To illustrate the efficiency of air conditioning units according to the principles of the present invention, one exemplary and non-limiting specific example will now be described. Based on a selection of 0.23 $m^3/s$ at 25 Pa, 70% fan efficiency and 90% motor efficiency, the fan power consumption will be about 9 W. Serving a floor area of 25 $m^2$, this is a fan energy consumption of 0.36 $W/m^2$. This is much lower than the usual "rule of thumb" concept design stage allowance of 5 $W/m^2$ for fan coil unit fan energy.

In the UK Building Regulations Part L there is a requirement to achieve a minimum Specific Fan Power (SFP) calculated as power (watts) per unit flow rate of air (litre/second). For fan coil units and other terminal units, the required SFP inferred from the Part L energy calculation is 0.3 or lower. Using the figures above the SFP is 0.039. This is again far better than the requirement.

The fan 28 is designed so that the air conditioning unit 2 will provide a swirling air flow pattern, similar to a swirl diffuser. The air discharges straight from the tips of the fan blades in a pattern that spreads out in a circular flow. This means that for minimal change of direction, and therefore minimal energy loss, a high induction air flow can be achieved.

It is desirable to minimise vibration from the fan 28 within the air conditioning unit 2 to minimise noise. Anti-vibration mounts 27*b* may be arranged at the points where the fan is supported. For example, the fan 28 may be supported by the stator 27 and connected via anti-vibration mounts 27*b*.

The front face of the air conditioning unit 2 comprises a perforated facia plate 20, with at least 50% opening at the outlets 22. This is sufficient for the air to pass through without altering the air flow characteristics.

As the air flow pattern from the fan 28 does not depend on the coanda effect from the adjacent ceiling, the air conditioning unit 2 can be pendant mounted (as will be discussed below) and will have the same air flow pattern as the unit 2 mounted in the ceiling. This fan arrangement also means that the air flow can be reduced to almost zero without cold air dumping. Cold air dumping is the phenomenon whereby a current of cold air, typically flowing horizontally below a ceiling and adhering to the ceiling due to the coanda effect, becomes detached from the ceiling, thereby falling down into the occupied space (dumping) with a consequent risk of cold draughts.

The air conditioning unit further includes air inlets 24 defined around the sides of the main body 3.

As discussed above, the thermal elements 26 are provided along three peripheral sides of the air conditioning unit 2. In this air conditioning unit 2, the thermal elements 26 comprise thermal coils 26*b* and heat exchange fins 26*a* for maximising thermal transfer. The coils 26*b* receive heated or chilled water via inlet pipe(s) 18*a*, which is then pumped through the coils 26*a* before being returned via the return pipe(s) 18*b* to be regenerated. The condensate pump 52 may be located below or adjacent to the changeover and control valves, 32*a* and 32*b*, and pumps condensed water into the condensate return pipework 18*c*.

Figure 4:
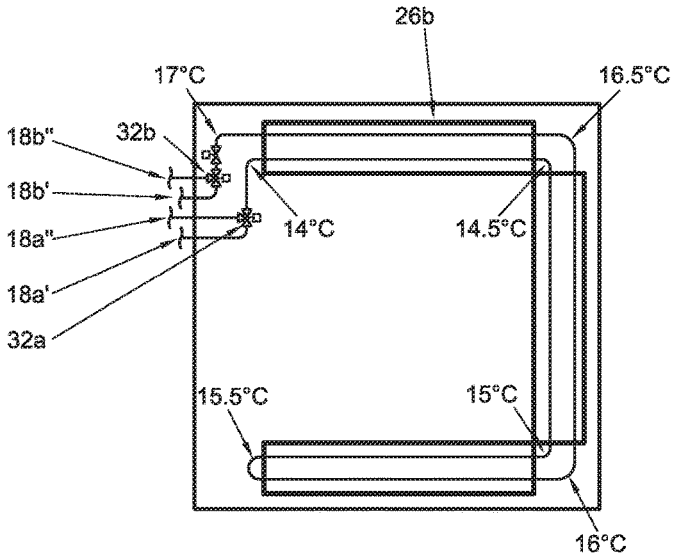
FIG. 4 shows a schematic plan view of the thermal coils of the air conditioning unit of FIG. 1.
Figure 5:
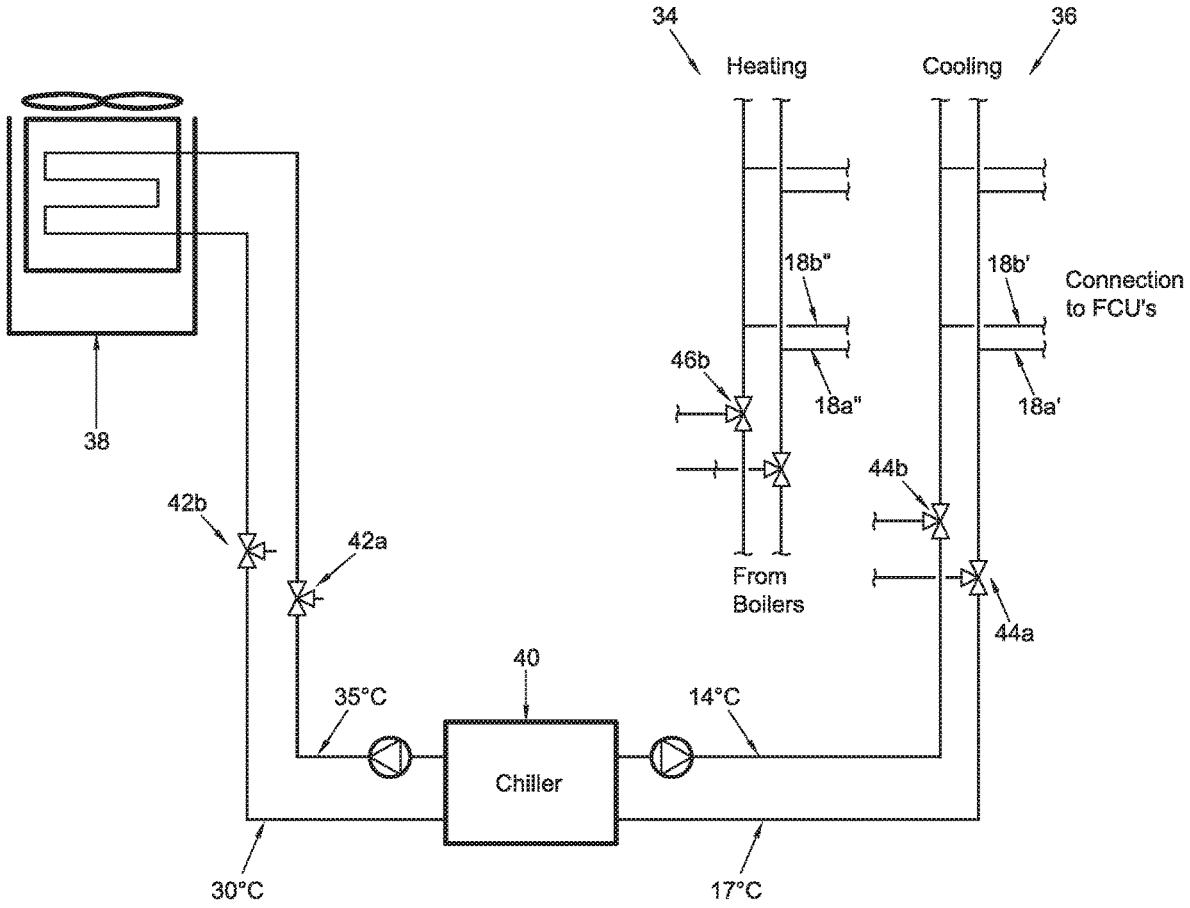
FIG. 5 shows a schematic view of a primary piping arrangement for supplying the cooling or heating liquid medium to the air conditioning unit of FIG. 1.

FIGS. 4 and 5 show schematically the thermal coil 26*b* and the corresponding HVAC infrastructure, respectively. The present air conditioning unit 2 uses a single coil 26*b*, having valves 32*a*, 32*b* to provide a changeover from the heating pipes 18*a*", 18*b*" to the cooling pipes 18*a*', 18*b*', as required. Whilst this adds complexity to the circuit, it reduces the energy loss when driving air through the coil 26*b*.

FIG. 4 shows a cooling arrangement where cool water is supplied via the cold inlet pipe 18*a*'. In order to maximise the heat transfer in the coil 26*b*, a counterflow heat exchanger arrangement is used. One exemplary and non-limiting specific example will now be described—the flow water at 14° C. enters the downstream set of pipework, passes horizontally through the coils, heating up to 15.5° C., then returns via the upstream set of pipework, and returns to the cold return pipe 18*b*' at 17° C. In the cooling mode (as illustrated in FIG. 4), a counterflow heat exchange configuration means that the coldest water (from the inlet pipe 18*a*') is adjacent to the air leaving the cooling coil 26*b* (radially inner side), and the warmer water (to the return pipe 18*b*') is adjacent to the air entering the cooling coil 26*b* (radially outer side). This gives the most efficient use of the heat exchange process, and gives the lowest possible air conditioner output temperature.

In an alternative arrangement, the changeover valves 32*a*, 32*b* and the heating medium inlet and return pipes 18*a*", 18*b*" may be omitted such that the coil 26*b* provides a cooling-only coil 26. In such an arrangement, separate heating units may be provided at the perimeter of the building for heating when necessary.

In a further alternative arrangement, a separate heating coil may be provided adjacent to a cooling-only coil 26*b*. This is the same configuration as a conventional cooling and heating ('4-pipe') fan coil unit. However, this has the disadvantage of increasing the coil pressure drop, and thereby increasing energy use and decreasing the overall air conditioning unit efficiency.

The present arrangement is a two-row coil 26*b*, split into three sections on each of three sides of the air conditioning unit 2. This is merely exemplary and other numbers of section and/or rows could be used, for example air inlets 24 and corresponding sections of the coil 26*a* may be provided only on two sides. Also, one-row or three-row coils 26*a* may be appropriate depending on the duty.

FIG. 5 shows an FIVAC infrastructure for supplying cooling or heating medium to a plurality of air conditioning units 2. Within the infrastructure, the cooling system 36 for the air conditioning unit 2 is generally independent from the heating system 34. First the cooling system 36 will be described.

The cooling system 36 comprises a condenser 38, such as a cooling tower, and a chiller 40. The cooling medium (e.g. water) for the air conditioning units 2 is cooled by the chiller 40 and the heat is dissipated by the condenser 38.

Conventional fan coil operating temperatures are in the region of about 60 flow and about 10 to 12° C. return. However, these temperatures will give rise to condensation under the majority of room conditions, and a condensate removal system must therefore be included.

An alternative approach is to use higher water temperatures, typically 10 to 12° C. flow and 14 to 16° C. return, in order to avoid condensation. These temperatures will not give rise to condensation under the majority of room conditions (although a condensate removal system is typically still included).

The present air conditioning unit 2 has been selected to have the option to run using low energy sources which are non-refrigerated, with temperatures of 14° C. flow and 17° C. return, though other operational temperatures could be used.

During one mode of operation, the cooling medium is cooled to flow temperature using the chiller 40. In another mode of operation, water from the condenser 38 (the cooling tower) can be used directly as a refrigerated source. In the UK it is possible to run such an arrangement for a significant portion of the year using the condenser water from the cooling tower 38 for cooling directly. To deliver a design flow temperature of 14° C. directly from a cooling tower, the ambient wet bulb temperature would have to be 11° C. or lower, based on a tower size, to give a 3° C. difference between the wet bulb and the flow temperature. In London, for example, ambient wet bulb temperatures are below 11° C. at least 50% of the hours in the year.

Thus, in the winter, the water from the cooling tower 38 could be connected directly to the air conditioning unit 2 by connecting cooling tower flow and return valves 42*a*, 42*b* to respective cooling circuit system flow and return valves 44*a*, 44*b*. In the summer, the cooling tower 38 would connect to the chiller 40, with condenser water temperatures of, for example, 30° C. flow and 35° C. return. The chiller 40 would generate chilled water at the desired temperatures.

Other sources of low energy cooling water may also be used, for example the cooling tower 40 may be replaced or supplemented by using, for example, river water and/or ground water.

If a water-cooled chiller 40 is used for the cooling options, at high ambient temperatures, e.g. operating at temperatures of 35° C./30° C., the refrigeration circuit can be arranged to provide condenser water from the cooling tower 38 to the heating system 34 by connecting the cooling tower flow and return valves 42*a*, 42*b* to respective heating circuit system flow and return valves 46*a*, 46*b*. This can be used for heat recovery, providing 'free' heating to the air conditioning units 2 that require heating.

As discussed above, even where relatively high operating temperatures are used to minimise condensation, it is still common to include a condensate removal system 50 (although this could be omitted if desired). Use of a condensate removal system 50 then allows the air conditioning unit 2 to be operated at lower temperatures, if desired. It also means that the unit 2 can be used in a mixed mode building, i.e. where natural ventilation is used for parts of the year. (In a fully air conditioned building with a sealed façade the humidity can be kept to a low figure, such as 40% RH, to avoid condensation. In a naturally ventilated building this is not possible, and a humidity of up to 100% RH may occur, which would cause condensation on a cold surface such as an air conditioning unit cooling coil).

Figure 6:
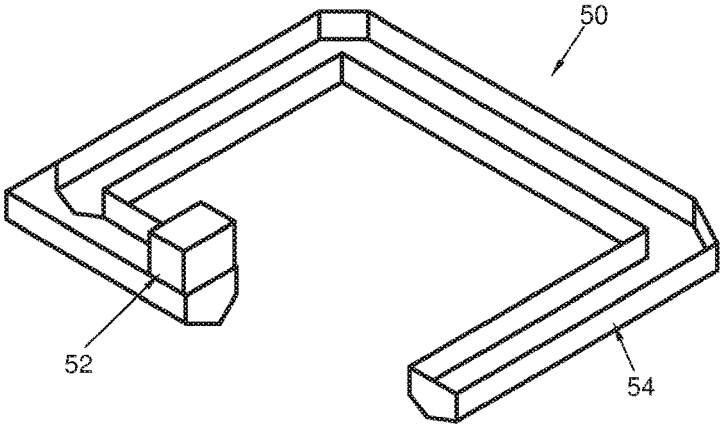
FIG. 6 shows a schematic view of a condensate removal system of the air conditioning unit of FIG. 1.
Figure 7:
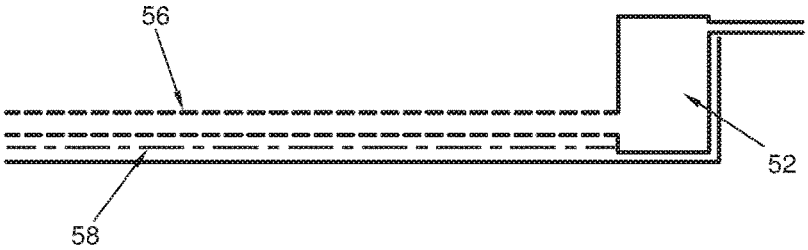
FIG. 7 shows a longitudinal sectional view through the condensate removal system of FIG. 6.
Figure 8:
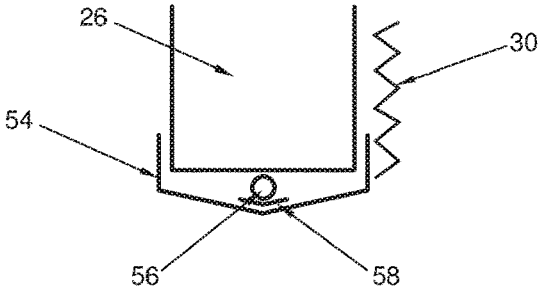
FIG. 8 shows a transverse sectional view through the condensate removal system of FIG. 7.

FIG. 6 shows a condensate removal system 50 for the air conditioning unit 2. FIG. 7 shows a longitudinal section through the condensate removal system 50, and FIG. 8 shows a transverse section through the condensate removal system 50.

Due to the shallow depth of the air conditioning unit 2, gravity drainage may not be feasible. When gravity drainage is not possible and condensate removal is required it must be by pumping. The condensate removal system comprises a condensate pump 52 and a drip tray 54, made of for example plastic, aluminum or other suitable material, provided below one or more cool elements of the unit 2, such as portions of the cooling coil 26*b* and/or the cool water control valves 32*a*, 32*b*. The condensate pump 52 is preferably of the variable geometry type, which does not require a sump or float switch. The pump 52 will run slowly to remove condensate as it collects in the drip tray 54, in contrast to a centrifugal pump which requires a sump and only pumps the condensate after a sufficient quantity has accumulated.

A hydrophilic condensate collection member 56, for example in the form of a pipe with a hydrophilic coating, is provided, which preferably runs the length of the drip tray 54. The hydrophilic coating allows water to pass through the coating but not air. This means that the member 56 will collect condensate at any point along its length.

A moisture sensor 58, for example a moisture sensitive conductor is also provided, which also preferably runs the length of the drip tray 54. If a moisture above a threshold moisture level is detected, then the pump 52 is activated. The condensate control system 50 may also have an override to turn off the chilled water supply and fan 28 in the event that the condensate accumulates, for example if there is a fault.

By use of this condensate control system 50, all condensate is trapped by the hydrophilic member 56 and then pumped out of the air conditioning unit 2 by the pump 52.

The air conditioning unit 2 is designed to be installed in two phases, corresponding to first fix and second fix. First, an installation frame 60 is installed at the time of first fix.

Figure 9:
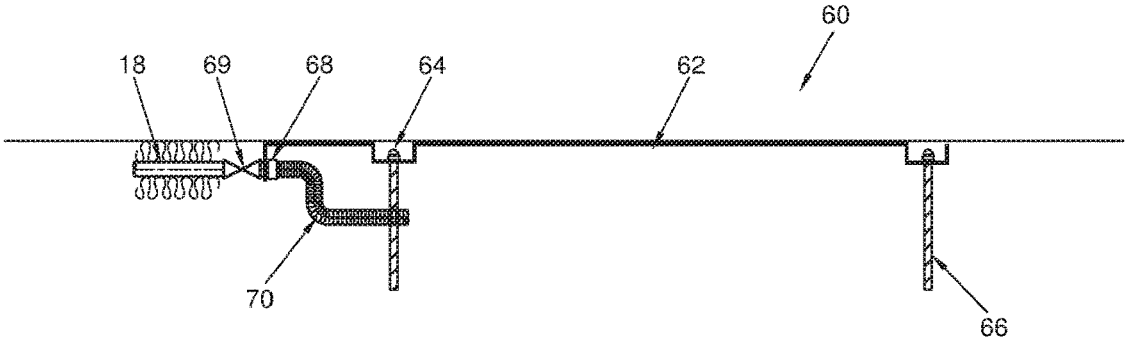
FIG. 9 shows a sectional view of an installation frame of the air conditioning unit of FIG. 1.
Figure 10:
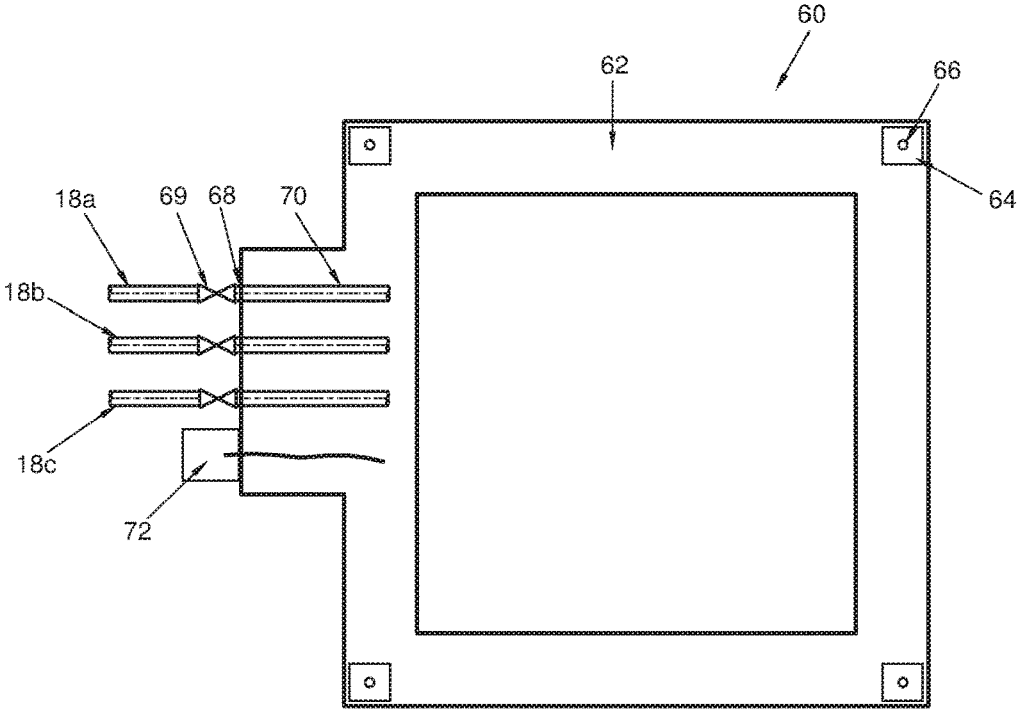
FIG. 10 shows a plan view of the installation frame of the air conditioning unit of FIG. 1.

The installation frame 60 is shown in section in FIG. 9 and in plan in FIG. 10. The main body 3 of the air conditioner unit 2 is then installed in second fix, shown in FIG. 11.

The installation frame 60 comprises a rigid body portion 62 adapted to be mounted to the soffit of the ceiling during a first fix. The rigid body portion 62 further comprises raised sections 64, preferably adjacent the corners of the body portion 62, adapted to receive threaded rods 66, for example via internally-threaded through holes. The threaded rods 66 provide the frame 60 with means for mounting the main body 3 of the air conditioning unit 2 to the installation frame during the second fix.

The installation frame 60 may further comprise fluid connection points 68 for certain services 18, such as inlet and outlet cooling/heating medium pipes 18*a*, 18*b*, to be attached the installation frame 60. FIG. 10 illustrates one pair of pipes—as described before there may be two pairs if a there is a 4 pipe system. Within the installation frame 60 may also be provided flexible connections 70 for linking the fluid connection points 68 of the installation frame 60 to the main body 3 of the air conditioning unit 2, when it is installed during the second fix. The connection points 68 should each include an isolation valve 69 to allow the main body 3 of an individual air conditioning unit 2 to be removed without shutting down services to a larger network.

Similarly, the installation frame 60 may also comprise electrical connection points 72 for other services 18, such as power and control cables, to be attached to the installation frame 60. The electrical connection points 72 may each comprise a fused spur and interface box.

The flexible pipes and cables are preferably located to be sufficiently short for them to be accessed by hand from below through the main body of the air conditioning unit when it is open in 'self-access' mode.

The following sequence is recommended for installation:

First fix

Preparation of the underside of ceiling slab (i.e. to be level, dry and clean).

Setting out the ceiling grid and components.

Fixing of the installation frame 60 to the ceiling slab (or set out correctly for false ceiling grid).

Installation of services pipework, terminating at the fluid connection points 68 on the installation frame 60.

Installation of power and controls cables, terminating at the electrical connection points 72 on the installation frame 60.

Installation of power and cabling and pipework for other services (those not for the air conditioning units 2).

Second fix

Installation of the ceiling grid.

Installation of the lights and other major ceiling components.

Installation of the ceiling tiles.

Mounting of the main body 3 of the air conditioning unit 2 onto the installation frame 60.

There are many components in a typical false ceiling, and some require more access than others. Typically the chilled water (CHW) & low-temperature hot water (LTHW) pipework, sprinkler pipework, cable trays and cables will be installed as first fix items, and will remain relatively unchanged until there is a major fit-out. These components are unlikely to require access once they have been installed.

Figure 12:
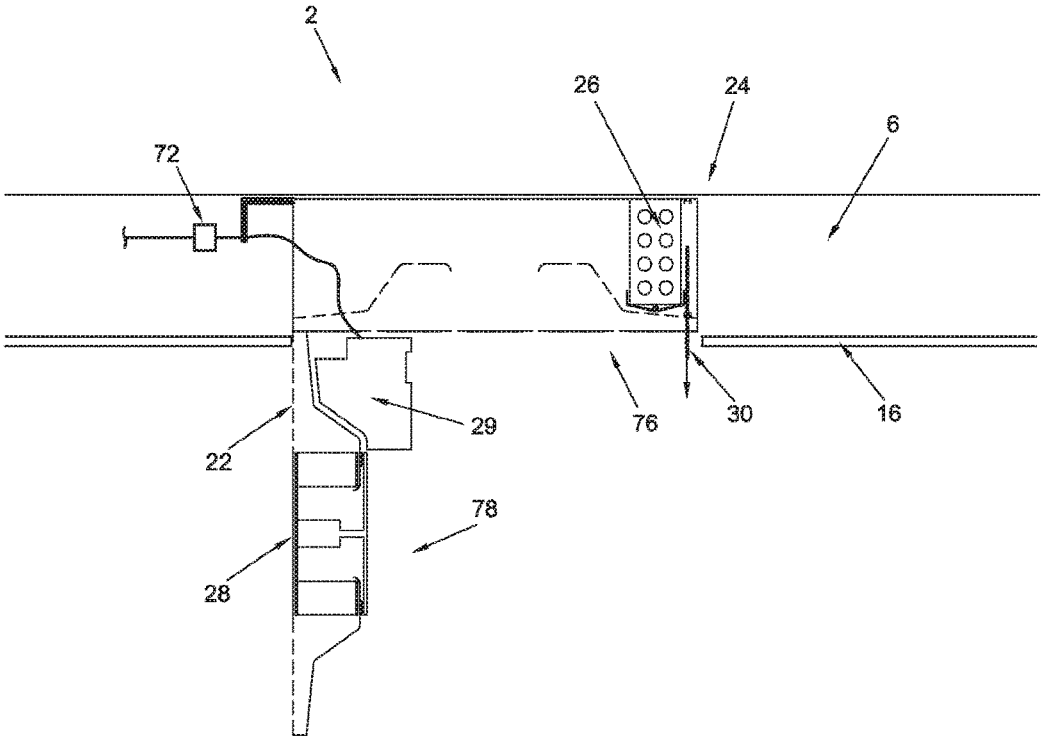
FIG. 12 shows a schematic view of the air conditioning unit of FIG. 1 in a maintenance position.

The components that typically do require access, either for commissioning after the ceilings are up, or later for maintenance, include lamps, smoke detectors, and the HVAC components, such as balancing dampers, balancing valves, fan coil filters and control boxes. These components are accessed in traditional installations with either access panels or a fully accessible ceiling. Conversely, the air conditioning unit 2 described herein is arranged to provide self-access, as illustrated in FIG. 12.

The main body 3 of the air conditioning unit 2 is composed of two housing portions 76, 78. The first housing portion 76 is mounted to the ceiling, for example via the installation frame 60. The second housing portion 78 is attached to the first housing portion 76 via a hinge such that it can be rotated from an operational position (as in FIG. 2) to a maintenance position (shown in FIG. 12). When moving into the maintenance position, the second housing portion 78, which includes the front face of the main body 2, swings into the thermally controlled space 8 to provide access to the components of the air conditioning unit 2.

The thermal elements 26 are mounted within the first housing portion 76. This means that the cooling/heating medium supply does not need to be disconnected when maintenance is being performed on the air conditioning unit 2.

The fan 28, stator 27 and motor are mounted within the second housing portion 78 such that they swing down with the second housing portion 78 when it is moved into the maintenance position. This allows a worker performing maintenance (when using a ladder) to work at eye level in front of him, rather than working on a unit 2 above his head, as has been the case with traditional fan coil units that could be maintained in situ. This working position is safer and more comfortable.

The fan 28 may include a fan control box 29, which is also mounted on the second housing portion 78. A display of the fan control box 29 can then be arranged to be easily read by the worker doing the maintenance or commissioning. Again, this can be read easily at eye level, rather than requiring the worker to look upwards when working.

In the maintenance position, the various motorised valves (such as changeover valves 32*a*, 32*b* and isolating valves 69) of the air conditioning unit 2 are easily accessible as the fan has been moved out of the way with the second housing portion 78. The condensate pump 52 and drip tray 54, which are also mounted to the first housing portion 76, are similarly easily accessible.

The filters 30 are positioned such that they can slide vertically downwards for cleaning or changing in the maintenance position.

Figure 11:
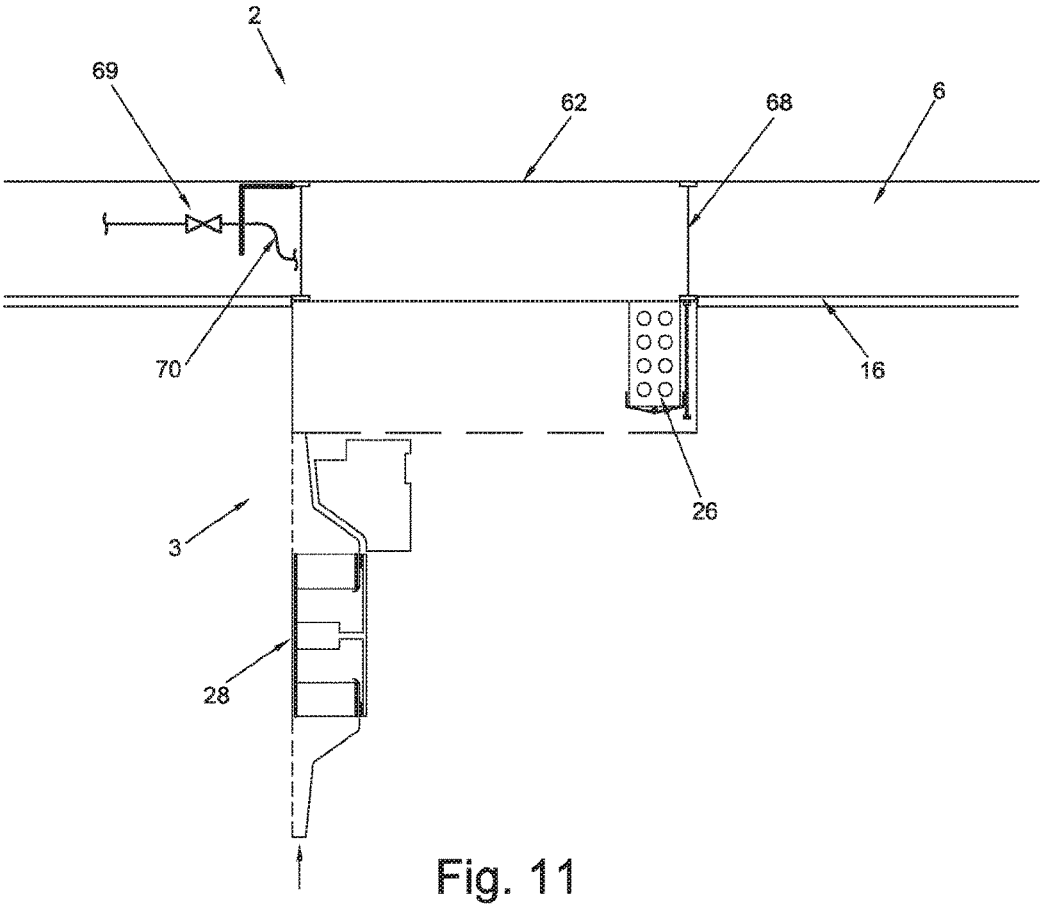
FIG. 11 shows a schematic view of the air conditioning unit of FIG. 1 being installed into a ceiling.

As illustrated in FIG. 11, the air conditioning unit 2 can be disconnected and dropped out of the ceiling if required. To do this, the second housing portion 78 is swung down into the maintenance position, the connections to power, cooling/heating medium and condensate are isolated (via valves 69) and the flexible connections 70 disconnected, and the four corner fixing bolts 68 are unscrewed from the first housing portion 76 to disconnect it from the installation frame 60. The whole air conditioning unit 2 can then be carefully dropped out of the ceiling.

Figure 13:
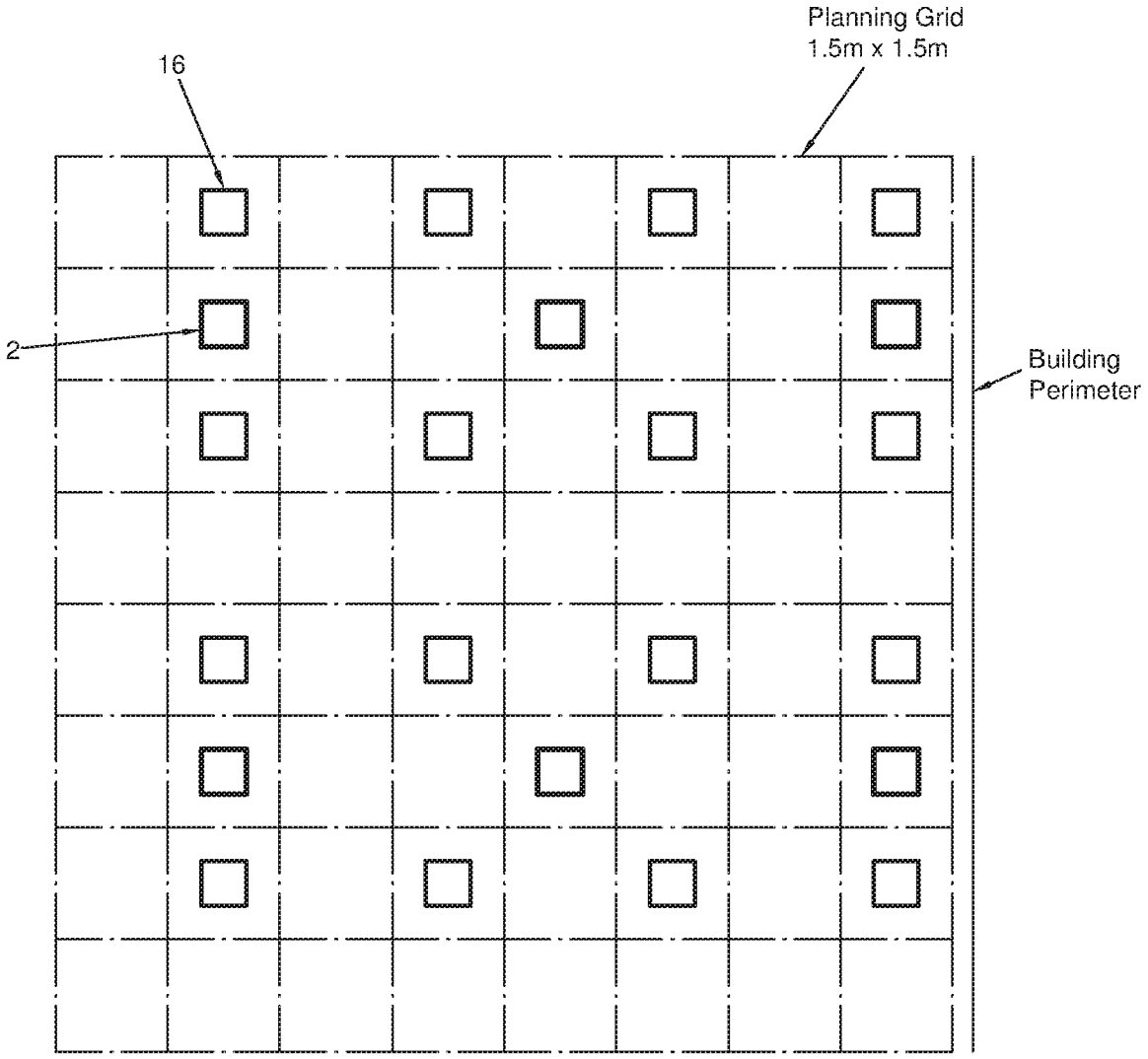
FIGS. 13 and 14 show schematic views of exemplary ceiling layouts incorporating the air conditioning unit of FIG. 1.
Figure 14:
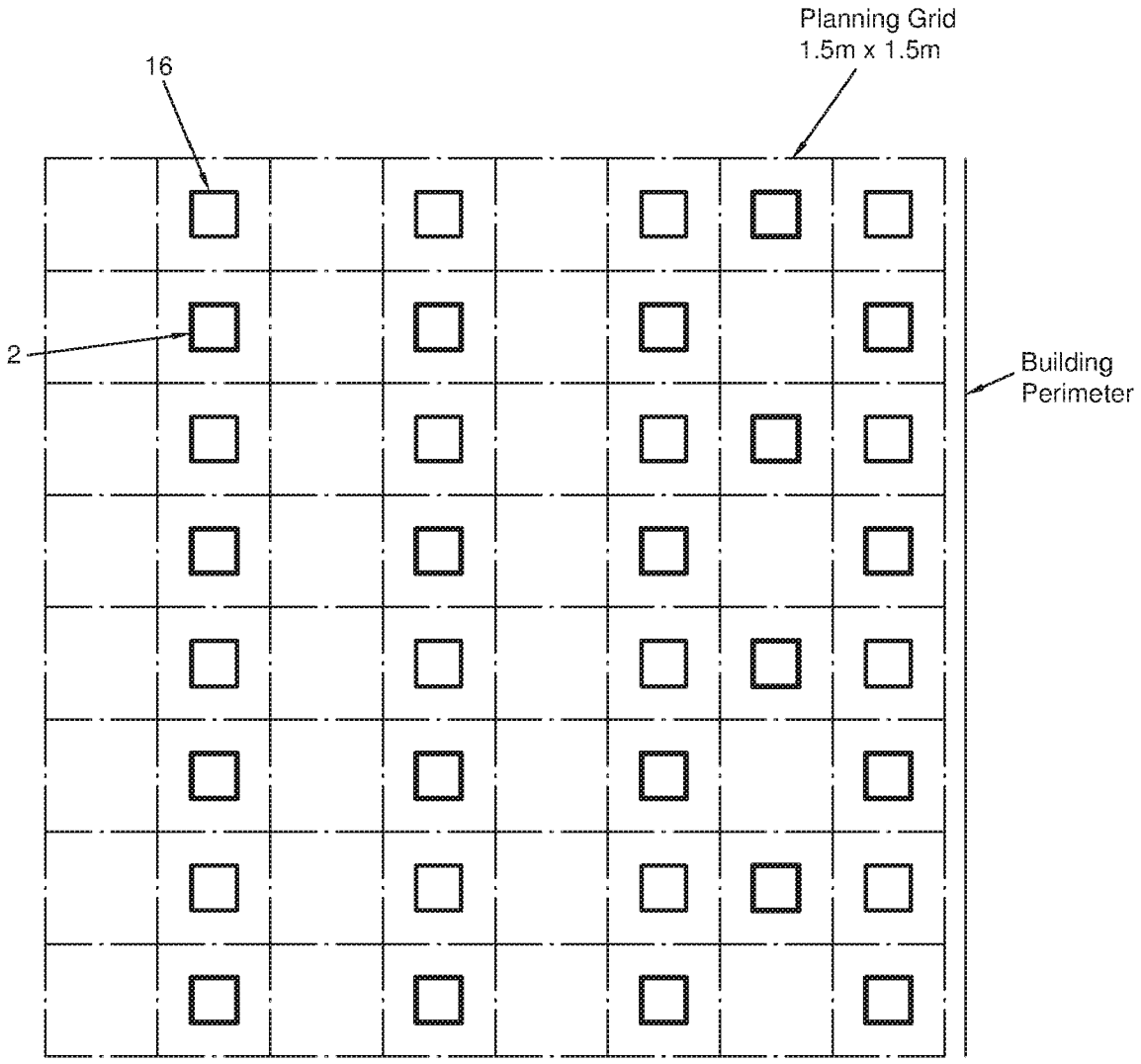

FIGS. 13 and 14 show exemplary ceiling layouts incorporating the air conditioning unit 2.

In the FIG. 13 layout, the light fixtures 16 are arranged to provide one light fixture 16 per 9 $m^2$ and the air conditioning units 2 are arranged to provide one air conditioning unit 2 per 24 $m^2$.

In the FIG. 14 layout, the light fixtures 16 are arranged to provide the same lighting density as in the FIG. 13 layout, but the air conditioning units 2 are arranged to provide one air conditioning unit 2 per 7.2 $m^2$. Furthermore, a greater density of air conditioning units 2 is provided at the periphery of the building (right-hand side of FIG. 14) to account for fabric load (external conditions).

FIGS. 15 to 25 illustrate various alternative arrangements of the air conditioning unit 2 discussed above with reference to FIGS. 1 to 14. Except for the differences discussed below, the configurations of the following alternative air conditioning units are the same as in the air conditioning unit 2 discussed above.

Figure 15:
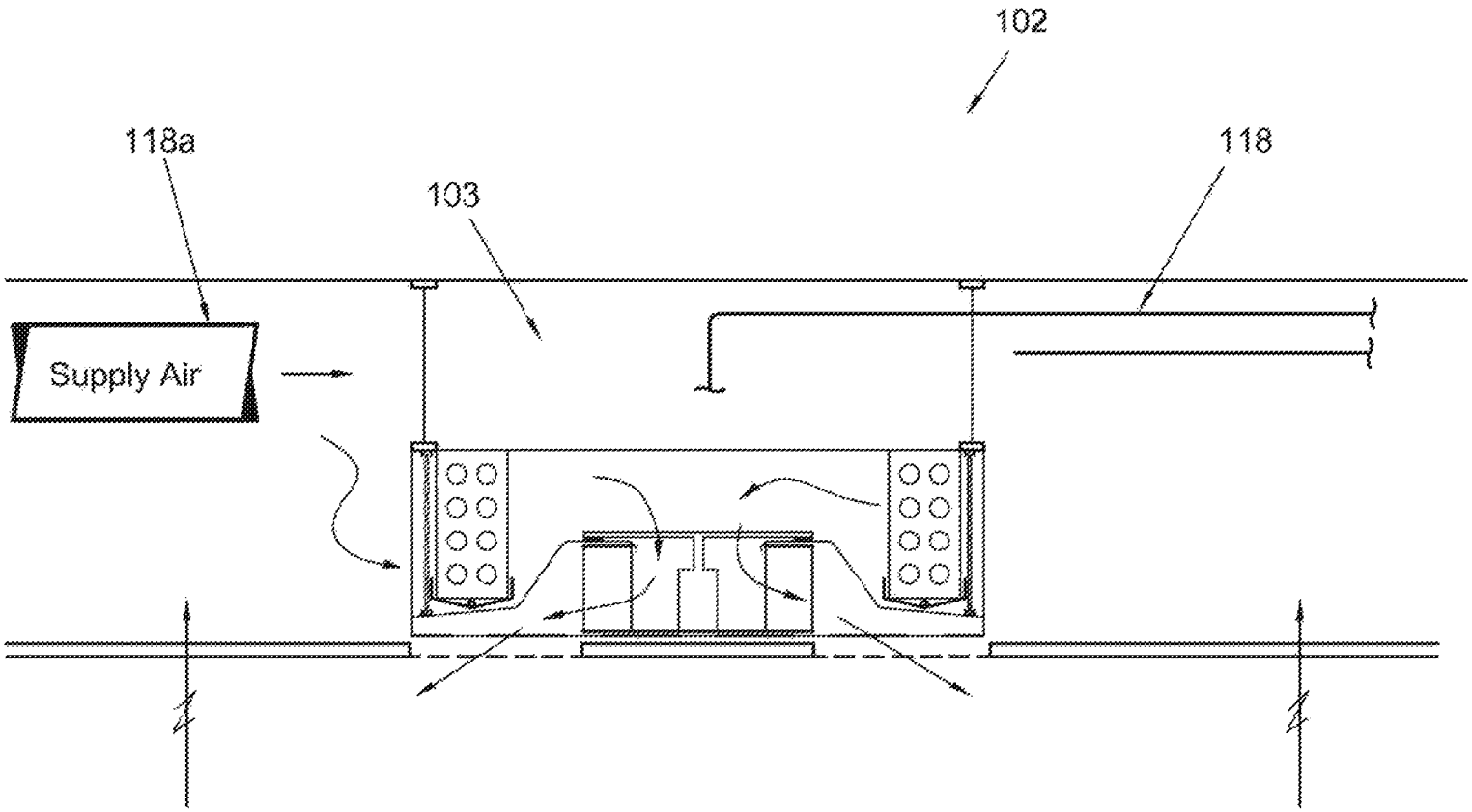
FIG. 15 shows a sectional view of an alternative air conditioning unit.

FIG. 15 shows an air conditioning unit 102 in which the main body 103 of the air conditioning unit 102 is the same as the main body 3 of the first air conditioning unit 2 shown in FIGS. 1 to 14.

In FIG. 15, the air conditioning unit 102 has been installed in a ceiling having a more conventional ceiling depth of around 500 mm. The main advantage of this is that it permits the use of a ducted outside air supply 118*a*, rather than using a plenum floor supply 4 as used by the air conditioning unit 2 shown in FIGS. 1 to 14.

Figure 16:
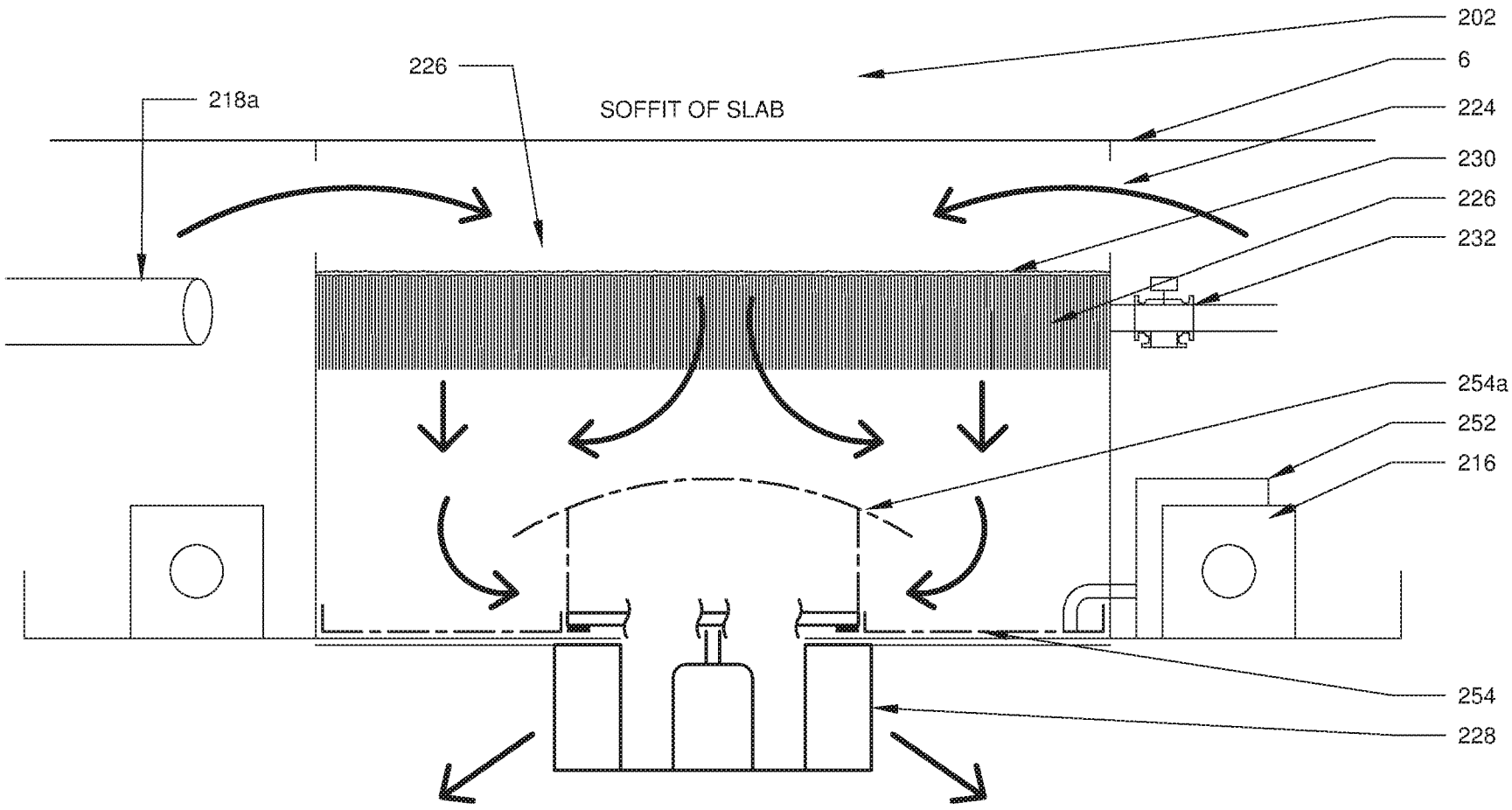
FIG. 16 shows a sectional view of another alternative air conditioning unit.

FIG. 16 shows an air conditioning unit 202 in which the thermal element 226 comprises a chilled beam 226. The use of a chilled beam 226 provides a very large area thermal element. This increases thermal conduction between the airflow and the thermal element 226, as well as reducing the pressure drop across the thermal element 226.

Whilst this configuration requires a thicker unit 202, as in FIG. 15, this then permits the use of a ducted outside air supply 218*a*.

In this arrangement, the air inlets 224 are still arranged at the side faces of the air conditioning unit 202, about its periphery. The air is drawn into the air conditioning unit 202 horizontally via the air inlets 224, and then drawn vertically downwards through an air filter 230 and then through the chilled beam 226 by the fan 228. It is then output by the fan 228 in a swirl pattern into the temperature controlled space 8.

Where a chilled beam 226 is used instead of a cooling coil 26*b*, certain modification may be made to the condensate removal system. In this air conditioning unit 202, a condensate shield 254*a* is provided above the fan 228 to prevent condensate falling into the fan 228. A condensate tray 254 is arranged vertically below the chilled beam 226, i.e. across the rear of the front face, to collect condensate from the chilled beam 226. The condensate shield 254*a* is arranged to direct condensate that would fall into the fan 228 into the condensate tray 254.

As above, a hydrophilic member is provided within the condensate tray 254 to collect the condensate, and a condensate pump 252 is used to draw the condensate along the hydrophilic member and out of the air conditioning unit 202.

Figure 17:
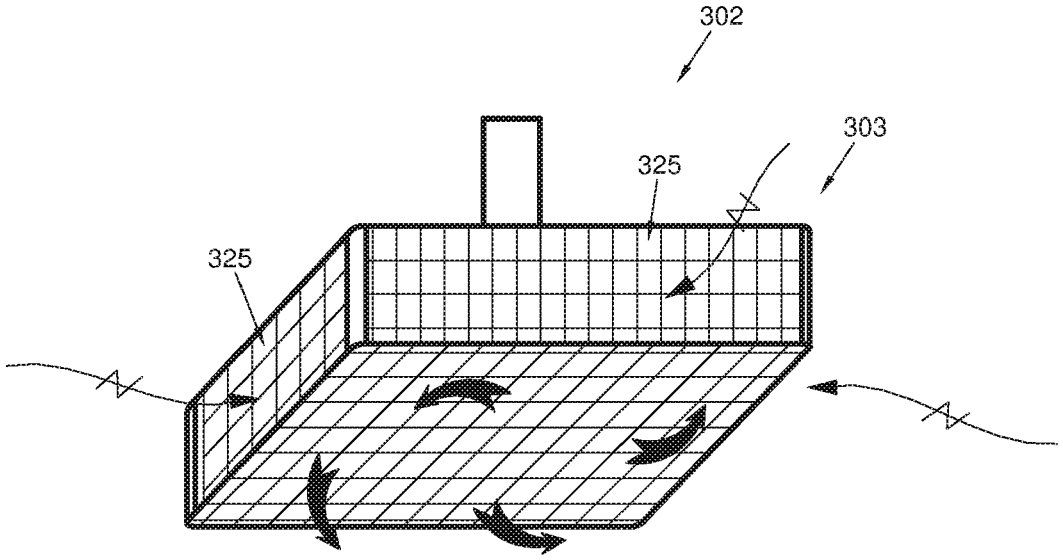
FIG. 17 shows a sectional view of a further air conditioning unit.

FIG. 17 shows pendant suspension configuration, in which a main body 303 of an air conditioning unit 302 is suspended from the ceiling. This may be appropriate for retail use, or restaurants, with exposed ceilings. There is also a move in office design towards removing suspended ceilings and having exposed services and suspended units.

In this configuration, the side faces of the main body 303 comprise perforated facia panels 325, which may be hinged to permit access to the filters around the periphery of the front face of the main body 303.

The internal structure of the main body 303 of the air conditioning unit is unchanged from that of the main body 3 of the air conditioning unit 2 shown in FIGS. 1 to 14.

Particularly, as discussed above, the air discharges straight from the tips of the fan blades in a pattern that spreads out in a circular flow. As the air flow pattern does not depend on the coanda effect from the adjacent ceiling, the air conditioning unit 302 can be pendant mounted whilst still achieving the same air flow pattern as the unit 2 mounted in the ceiling.

Figure 18:
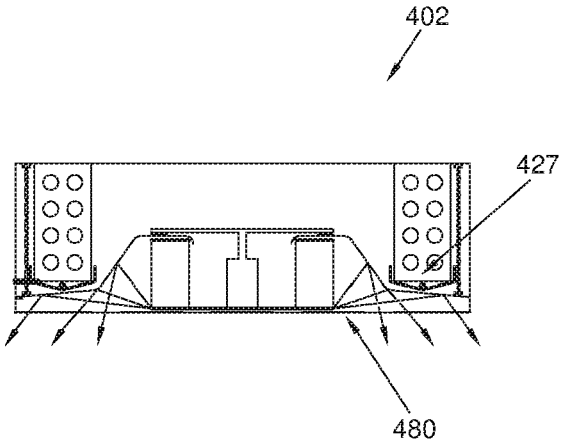
FIG. 18 shows a sectional view of a still further alternative air conditioning unit.

FIG. 18 illustrates a modification that can be incorporated into any of the air conditioning units discussed herein.

In this arrangement, the inclined surface of the stator 427 is used as a diffuser to bounce the intense light from LED sources 480, to produce a diffuse lighting effect in the space below. The perforated plate 22 covering the complete underside of the air conditioning unit is not present in this arrangement—the plate is solid, and reduced in width to the minimum needed to cover the fan and support the LED sources 480. An advantage of integral lighting when applied to an exposed pendant version of the air conditioning unit 302 is that the unit 302 may be perceived as a light fitting, rather than as an unlit suspended shape.

Figure 19:
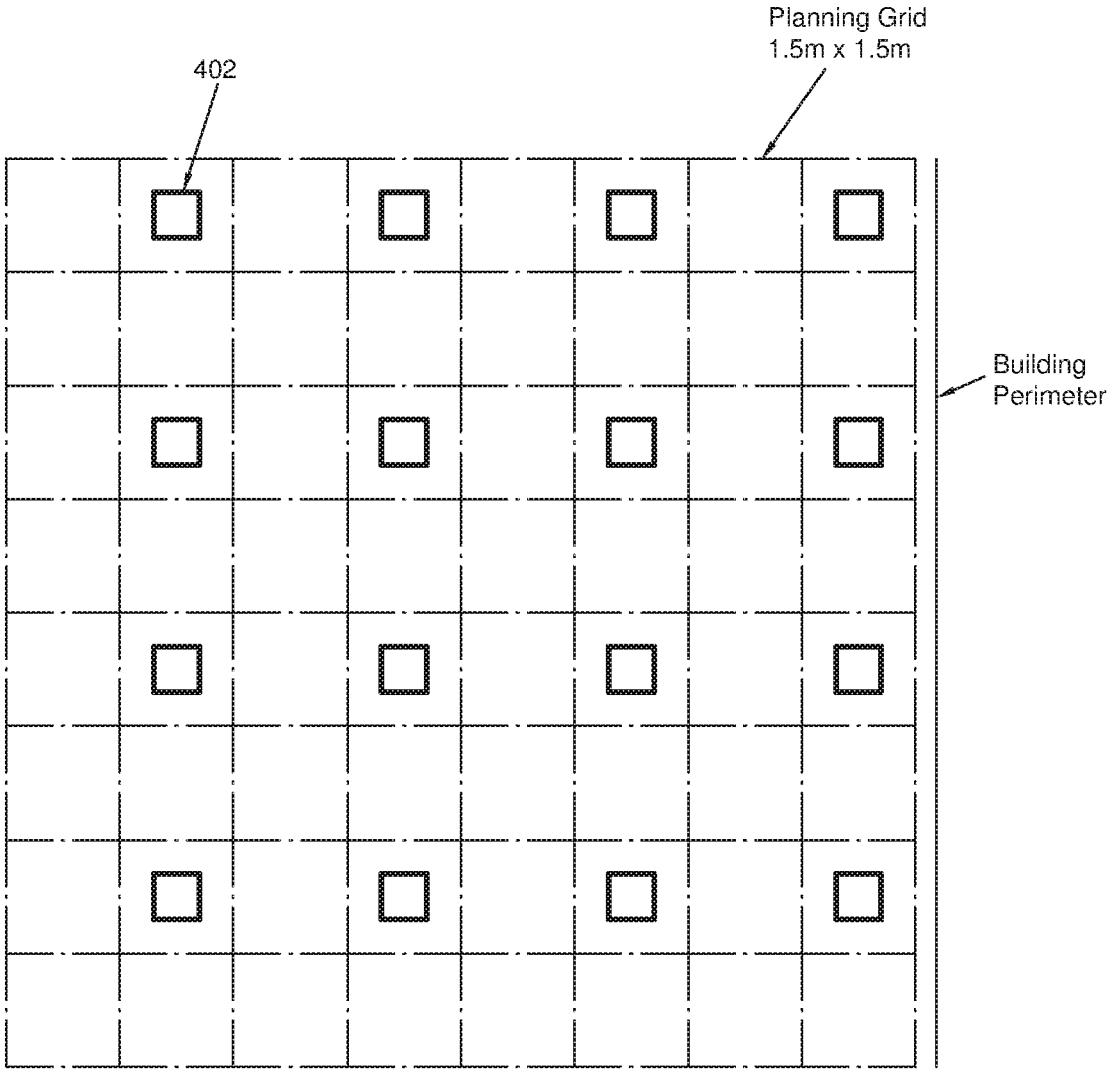
FIG. 19 shows schematic view of an exemplary ceiling layout incorporating the air conditioning unit of FIG. 18.

FIG. 19 show a further exemplary ceiling layout incorporating this air conditioning unit 402. In order to provide the desired lighting density, one air conditioning unit 402 per 9 m2 is provided. However, this is not visually obtrusive as the air conditioning units 402 is not perceived as such.

Figure 20:
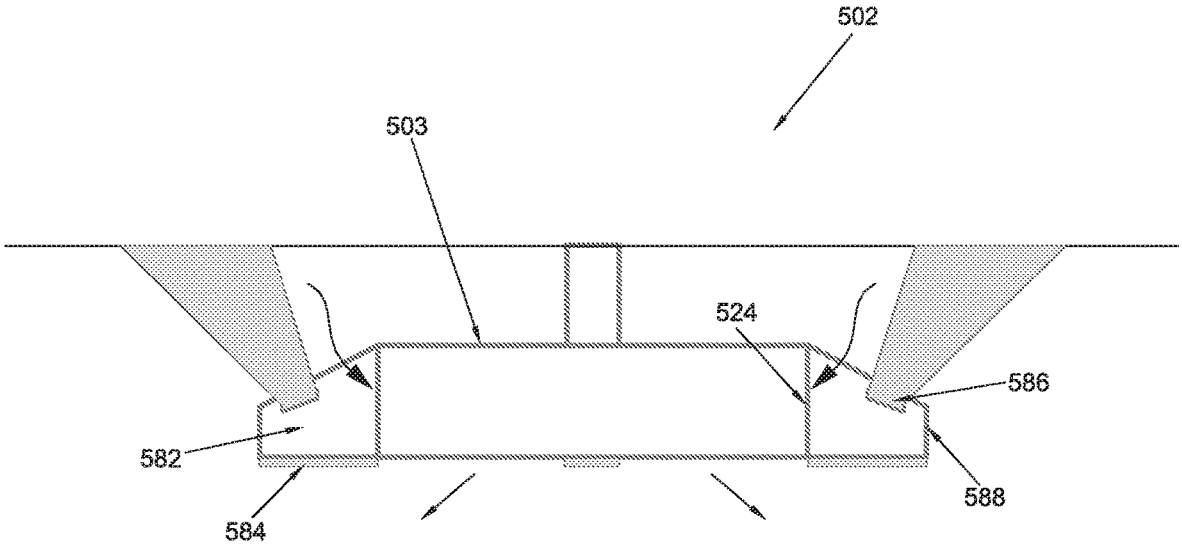
FIG. 20 shows a sectional view of another air conditioning unit.
Figure 21:
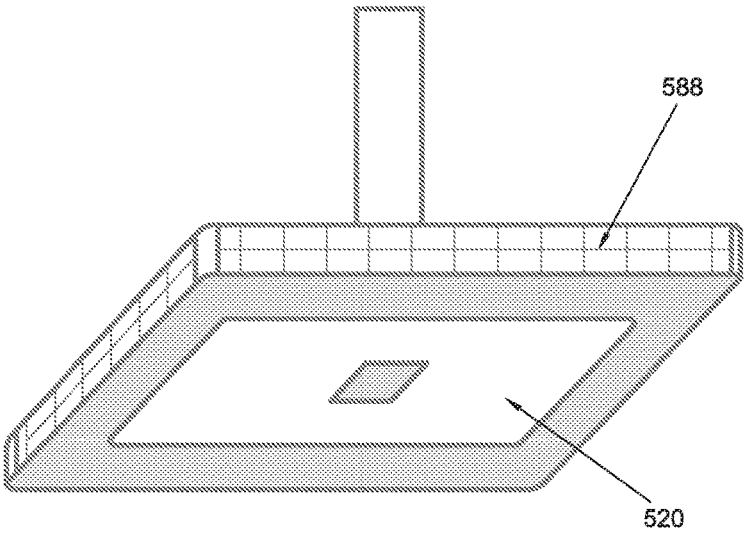
FIG. 21 shows a perspective view of the air conditioning unit of FIG. 20.

FIGS. 20 and 21 illustrate an air conditioning unit 502 which is a variation of the pendant air conditioning unit 302 shown in FIG. 17.

The main body 503 of the air conditioning unit 502 is suspended from the ceiling. The air conditioning unit 502 further comprises a rim member 582. The rim member may comprise downward-directed lights 584 and/or upward-directed lights 586.

The air conditioning unit 502 is arranged to be visually appealing by having a relatively wide unit 502 with a slim profile. The intention is for the visible depth, i.e. the height of side panels 588 of the rim member 582, to be about 10% of the width of the air conditioning unit 502. As can be seen in FIG. 20, the rear face of the rim member 582 is sloped such that the sloping back panels will be hard to see from below. In this example, the side panels 588 of the rim member 582 have a height of about 100 mm and the rim member 582 has a width of 200 mm. This results in an air conditioning unit 502 having apparent dimensions of about 1000 mm×1000 mm×100 mm.

The side panels 588 and facia plate 520 preferably have a high quality finish, such as stainless steel. To provide a "clean" appearance, the back panels of the rim member 582 may comprise perforated air inlets 590 to allow air to be drawn in on the non-visible upper side, through the rim member 582 into the air inlets 524 of the main body 503.

Figure 22:
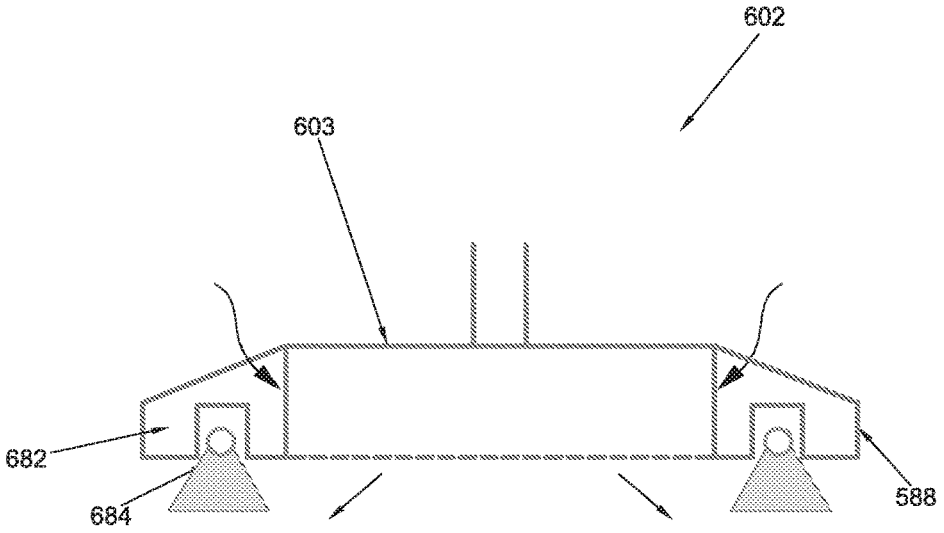
FIG. 22 shows a sectional view of yet another air conditioning unit.
Figure 23:
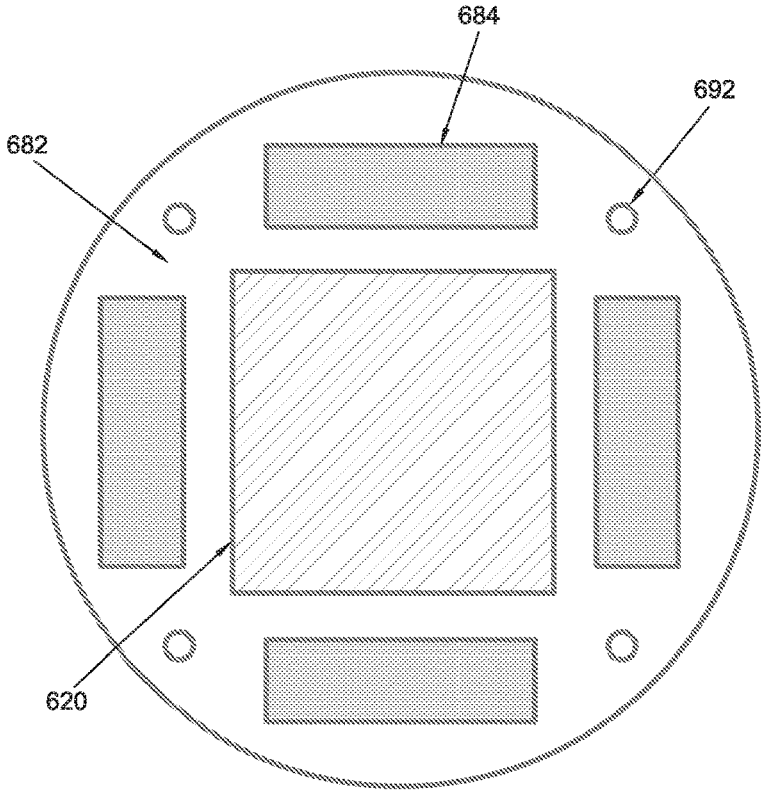
FIG. 23 shows a plan view seen from below of the air conditioning unit of FIG. 22.

FIGS. 22 and 23 illustrate a multi-service air conditioning unit 602 which is a variation of the pendant air conditioning unit 502 shown in FIGS. 20 and 21.

There has been a trend to use multi-service units 602 in offices, incorporating all of the MEP components required in a single unit. The multi-service air conditioning unit 602 has a rim member 682 that provides lighting 684, as well as various other services 692, such as smoke or heat detectors, sprinklers, public announcement/voice alarm loudspeakers, and/or PIR detectors.

FIGS. 24A to C show a vertical air conditioning unit. The air conditioning unit is the same as the air conditioning unit 2 shown in FIGS. 1 to 4, except that the condensate removal system 50 is modified so as to provide a drip tray spaced vertically below the thermal elements and a coil provided at an oblique angle.

The coils 26 are again provided on three sides. They are arranged so that condensate can be collected from each of the three coils. The top side of the unit contains the fan controls, the control valves and the condensate pump. There may be provided an upper small drip tray below this section, with a branch of the hydrophilic drain pipe.

The two side coils 26, which extend substantially vertically, have the same size and duty as in the air conditioning unit 2 shown in FIGS. 1 to 4. The lowest of the three coils, which extends substantially horizontally, is, in contrast, smaller in length and height, and is fitted at an angle of approximately 30 degrees from the vertical, as seen most clearly in FIG. 24B. The air flow enters the lower surface of the air conditioning unit across the whole width of the filter 30, which permits the pressure drop to remain low. The air passes to the side of the drip tray below the coil, through the coil and then up into the unit, as indicated by the arrows in FIG. 24B. The coil is angled at approximately 30 degrees from the vertical to permit the air to flow at an angle into the unit, in a region that is not covered by the drip tray. As seen in FIG. 24C, the drip tray 54, which is substantially planar (except for vertically projecting side walls) has an elongated central portion that extends across the entire width of the angled coil 26 and end portions that project from the ends of the central portion to lie entirely under the vertically extending side coils 26. Any condensate that forms on the face of the angled coil 26 will run down the face of the angled coil into the drip tray, to be caught by the central portion thereof. Any condensate that forms on the face of the vertically extending side coils will be collected by the end portions. Whilst, an angle of 30 degrees is stated here for the angled coil 26, various alternative oblique angles will provide the desired effect.

The cooling coil pipework connections between the side coils and the angled lower coil are intricate. The pipes on the upstream face in the vertically extending side coil are connected to the pipes on the upstream face in the horizontal angled coil, and then back to the upstream face on the opposite vertically extending side coil. The same applies to the downstream pipes. This keeps the pipework connection arrangement the same as shown in the arrangement of FIGS. 1 to 4.

A branch of the hydrophilic drain pipe runs down from the condensate pump at the top of the unit to remove condensate from the lower tray. In alternative arrangements, a gravity arrangement may be used to remove condensate from the two drip trays instead.

A void may be provided above, below or to the side of the unit to allow a return air path. Outside air can be ducted or supplied by a separate means.

It should be appreciated, whilst allowing for the angled coil and alternative condensate collection arrangement that any adaptations or alternatives stated in respect of the embodiments described above may be applied to the vertical arrangement described with reference to FIGS. 24A to C.

Vertical air conditioning units could be used in hotel or conference centre function rooms, in residential buildings, offices or schools. They could be located below window sills, they could further be used in underground transit stations/platforms and to cool computer rooms.

One option would be to use a 200 mm deep zone, as with the ceiling-based air conditioning unit 2. The face velocity, if based on 0.2 $m^3$/sec and a 600×600 diffuser, would be 0.55 m/s face velocity, which would be too high for some applications. However, if the depth of the unit 702 is increased to 250 to 300 mm and a diffuser plate 723 is used, then the face velocity can be reduced to 0.25 m/s. If the supply temperature was also to be set at 18° C., then the unit 702 would reproduce the supply conditions of a displacement diffuser, which is known to give acceptable comfort for occupants near the diffuser.

Figure 25:
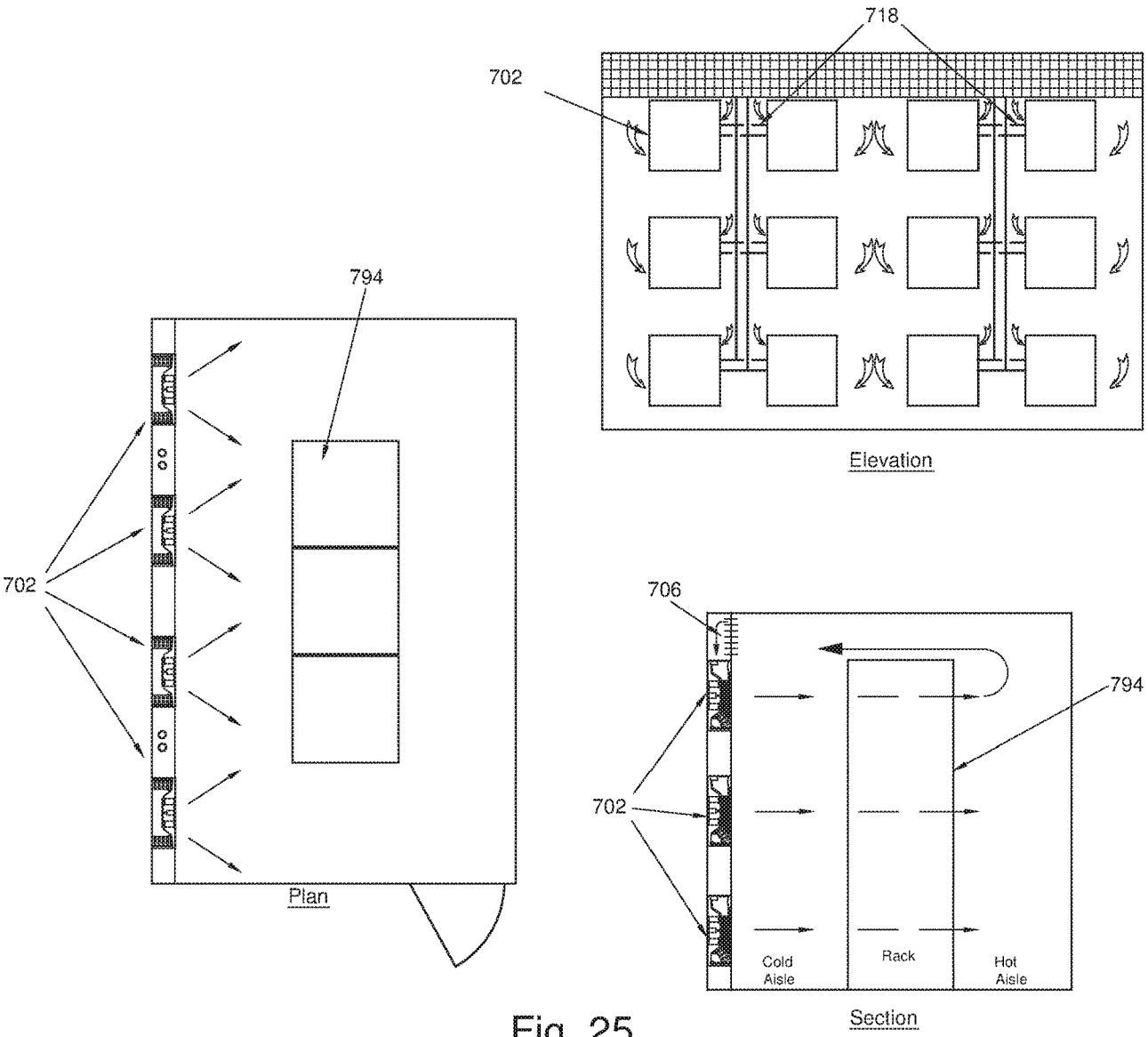
FIG. 25 shows a schematic view of an exemplary computer room layout incorporating the air conditioning unit of FIG. 24.

If an array of vertical air conditioning units 702 is installed in a wall it is possible to achieve the cooling loads need to cool for example a small computer room, such as an SER (Small equipment Room) or SCR (Sub Comms Room), with a single row of racks 794. This arrangement is illustrated in FIG. 25.

In the example sketched, with three computer racks 794 with a conventional cooling load of 1.5 kW each, the loads and cooling capacity will be:

Load
3 racks @ 1.5 kW=4.5 kW
Resilience required: N+1
Cooling capacity
Cooling load: 10 units @ 1.9 kW=19 kW
Resilience: 2 units @ 1.9 kW=N+2

The cooling capacity far exceeds the requirement of standard racks, and high density racks of 6.3 kW each could be accommodated.

All of the equipment and pipework is accommodated in the cooling wall, and no pipework runs above the electoral equipment.

I claim:

1. A fan, comprising:
a motor,
an impeller having an impeller axis of rotation, and
a stator, so as to define an air flow passage between an air inlet and an air outlet and a fan characteristic with a stall region,
wherein said motor, said impeller and said stator have a mode of operation and an arrangement so that an inlet air flow has an inlet trajectory through the air inlet of up to 360° in a direction perpendicular to said impeller axis of rotation, an outlet air flow has an outlet trajectory through the air outlet of up to 360° in a direction perpendicular to said impeller axis of rotation, and a passage air flow through the air flow passage has a 180° turn, and
wherein said mode of operation is a mode of constant operation with a set point within said stall region of said fan characteristic, such that the fan is constantly operating within the stall region, so as to sustain a radial outlet effect.

2. The fan as claimed in claim 1, wherein said outlet trajectory is radial and has a radial airflow pattern being formed in a direction up to 90° from said impeller axis of rotation.

3. The fan as claimed in claim 1, wherein said outlet trajectory is a radial outlet trajectory of up to 360 degrees.

4. The fan as claimed in claim 2, wherein said radial outlet trajectory is rotatable about said impeller axis of rotation.

5. The fan as claimed in claim 1, wherein said impeller is an axial impeller.

6. The fan as claimed in claim 1, wherein a height of the stator is one half of a height of the impeller.

7. The fan as claimed in claim 1, wherein a center of a height of the stator is positioned offset from a center of a height of the impeller so as to set an offset position of said stator.

8. The fan as claimed in claim 7, wherein said offset position is a distance of one third of the height of said impeller from one face of the impeller and a distance of one sixth of the height of said impeller from an opposite face of the impeller.

9. An air conditioning unit, comprising:
a fan, according to claim 1.

10. The air conditioning unit, as claimed in claim 9, further comprising:
a main body having a first face, said air outlet being disposed on said first face said air inlet and said air outlet defining said air flow passage between the air inlet and the air outlet on said first face, said fan being disposed within said main body; and a thermal element disposed within the said air flow passage upstream of said fan, said air inlet and said thermal element being disposed at a periphery of said first face.

11. The air conditioning unit according to claim 10, wherein said impeller axis of of rotation is perpendicular to the said first face.

12. The air conditioning unit according to claim 11, wherein said impeller axis of rotation is centered on said first face.

13. The air conditioning unit according to claim 10, wherein the first face is configured so as to be exposed to a temperature-controlled space.

14. The air conditioning unit according to claim 13, wherein the fan is positioned so as to vent air directly into the temperature-controlled space.

15. The air conditioning unit according to claim 10, wherein the air inlet and said thermal element extend along at least 50% of the periphery of the first face.

16. The air conditioning unit according to claim 10, wherein the air outlet and the airflow passage are arranged so as to set an airflow velocity through the airflow passage at the thermal element less than 50% of an airflow velocity through the airflow passage downstream of the fan.

17. The air conditioning unit according to claim 10, wherein the fan has a face velocity of about 0.8 m/s at the first face, an airflow velocity through the airflow passage at the thermal elements being between 0.5 and 1.5 m/s.

18. The air conditioning unit according to claim 10, wherein the thermal element is mounted to a first housing portion of the main body, and wherein the fan is mounted to a second housing portion of the main body, the second housing portion being hinged to the first housing by a hinge.

19. The air conditioning unit according to claim 18, wherein the second housing portion has a first position relative to the first housing portion for operation of said fan and a second position relative to the first housing portion for maintenance access, and wherein the second housing portion is rotatable between said first position and said second position by said hinge.

20. The air conditioning unit according to claim 10, further comprising:

an installation frame being configured to mount on a ceiling, said main body being mounted to said installation frame.

21. The air conditioning unit according to claim 10, wherein said thermal element comprises a thermal coil.

22. A structure, comprising:

the air conditioning unit of claim 10, a floor; and a ceiling having a ceiling void and being connected to said floor so as to define a temperature controlled space between said floor and said ceiling, wherein said main body is disposed within a said ceiling void, said first face is being exposed to said temperature controlled space.

23. The structure, according to claim 22, wherein said floor comprises a floor void in fluid connection with said temperature controlled space.

24. The A structure, comprising:

the air conditioning unit of claim 9, a floor;

a ceiling; and a vertical wall being connected to said floor and said ceiling so as to define a temperature controlled space defined between the floor, the ceiling and the wall, wherein said main body is disposed within said vertical wall, said first face being oriented vertically and exposed to said temperature controlled space.

25. The structure, according to claim 24, wherein the said vertical wall comprises a void adjacent said air inlet, said void being in gaseous communication with the said temperature controlled space.

* * * * *